US011519193B2

(12) United States Patent
Ma

(10) Patent No.: US 11,519,193 B2
(45) Date of Patent: Dec. 6, 2022

(54) ROTATION BASE FOR UMBRELLA

(71) Applicant: Zhun-An Ma, Ningbo (CN)

(72) Inventor: Zhun-An Ma, Ningbo (CN)

( * ) Notice: Subject to any disclaimer, the term of this patent is extended or adjusted under 35 U.S.C. 154(b) by 550 days.

(21) Appl. No.: 16/410,921

(22) Filed: May 13, 2019

(65) Prior Publication Data

US 2020/0141150 A1 May 7, 2020

(30) Foreign Application Priority Data

Nov. 2, 2018 (CN) ..... 201821806422.8

(51) Int. Cl.

| | |
|---|---|
| ***E04H 12/22*** | (2006.01) |
| ***E04H 15/28*** | (2006.01) |
| ***A45B 23/00*** | (2006.01) |

(52) U.S. Cl.

CPC ..... *E04H 12/2238* (2013.01); *A45B 23/00* (2013.01); *E04H 15/28* (2013.01); *A45B 2023/0012* (2013.01)

(58) Field of Classification Search

CPC ..... E04H 12/2238; E04H 15/28; A45B 23/00; A45B 2023/0012; A45B 2017/005; A45B 2023/0075; F16M 2200/021; F16M 2200/024

USPC ... 248/519, 521, 523, 345, 349.1, 27.8, 686, 248/688, 518, 346.01, 346.03, 346.06, 248/346.5

See application file for complete search history.

(56) References Cited

U.S. PATENT DOCUMENTS

| | | | |
|---|---|---|---|
| 1,261,142 | A | 4/1918 | McNichol |
| 1,711,831 | A | 5/1929 | Clavin |
| 1,838,199 | A | 12/1931 | Thomas |
| 1,940,523 | A | 12/1933 | Barclay |
| 2,036,033 | A | 3/1936 | Fisher |
| 2,146,658 | A | 2/1939 | Leopold |
| 2,475,406 | A | 7/1949 | Russell |
| 2,652,845 | A | 9/1953 | O'Neill et al. |
| 2,661,012 | A | 12/1953 | Militano |
| 2,952,471 | A | 9/1960 | Thorpe |
| 3,025,058 | A | 3/1962 | Brumfield |
| 3,119,588 | A | 1/1964 | Keats |
| 3,179,438 | A | 4/1965 | Field |
| 3,259,432 | A | 7/1966 | Jackson |
| 3,353,837 | A | 11/1967 | Marcyan |
| 3,372,855 | A | 3/1968 | Keith |

(Continued)

FOREIGN PATENT DOCUMENTS

| | | |
|---|---|---|
| DE | 93 13 372 | 10/1993 |
| DE | 202006002271 U1 | 6/2006 |

(Continued)

OTHER PUBLICATIONS

Activa Leisure, 2010 Product Catalog.

(Continued)

*Primary Examiner* — Christopher Garft
*Assistant Examiner* — Michael McDuffie
(74) *Attorney, Agent, or Firm* — Knobbe, Martens, Olson & Bear, LLP

(57) ABSTRACT

An umbrella assembly includes a rotation base. The rotation base can include a foot pedal for alternately enabling rotation and locking rotation of the umbrella assembly relative to the base. The actuator assembly can include a pin held in place by a clip for locking and enabling the rotation.

23 Claims, 14 Drawing Sheets

(56) References Cited

U.S. PATENT DOCUMENTS 3,606,445 A 9/1971 Wunderlich
3,632,029 A 1/1972 Sonner
3,633,242 A 1/1972 Wasofsky
3,635,491 A 1/1972 Drews et al.
D223,689 S 5/1972 Forbes
3,841,631 A 10/1974 Dolan
3,949,901 A 4/1976 Tokita
4,000,750 A 1/1977 Becher
4,063,616 A 12/1977 Gutierrez
4,069,559 A 1/1978 Weman
D255,958 S 7/1980 Browning
4,249,282 A 2/1981 Little
4,296,693 A 10/1981 Archer
4,586,525 A 5/1986 Glatz et al.
4,591,126 A 5/1986 Berney
D286,116 S 10/1986 Tegze
D295,004 S 4/1988 Schulz
4,790,029 A 12/1988 LaFleur et al.
D305,702 S 1/1990 Taliani et al.
4,903,859 A 2/1990 Derby et al.
4,973,327 A 11/1990 Goodrich, Jr. et al.
D323,582 S 2/1992 Volcani
5,104,236 A 4/1992 LaFleur
5,152,495 A 10/1992 Jacinto et al.
5,158,369 A 10/1992 Derby
5,167,393 A 12/1992 Hayakawa et al.
5,207,407 A 5/1993 Fitzsimmons et al.
5,209,364 A 5/1993 LaPoint, Jr.
5,220,740 A 6/1993 Brault
5,248,140 A 9/1993 Matherne et al.
5,257,983 A 11/1993 Garyantes et al.
5,259,612 A 11/1993 Matherne et al.
5,271,196 A 12/1993 Fanti
5,283,595 A 2/1994 Krukovsky
5,289,937 A 3/1994 Boots
5,322,023 A 6/1994 Hammond
5,323,922 A 6/1994 Lapoint et al.
5,328,268 A 7/1994 Lafleur
5,330,213 A 7/1994 Peruso
D350,041 S 8/1994 Schwarzli
5,337,989 A 8/1994 Apple
5,354,049 A 10/1994 Matherne et al.
5,375,835 A 12/1994 Van Nimwegen et al.
5,423,611 A 6/1995 Sherrard
5,452,877 A 9/1995 Riffle et al.
5,465,529 A 11/1995 Park
5,480,191 A 1/1996 Litin et al.
5,481,822 A 1/1996 Engels
5,492,429 A 2/1996 Hodges
5,520,982 A 5/1996 Grigsby et al.
D371,902 S 7/1996 Lee
5,538,155 A 7/1996 Hoekstra
5,599,037 A 2/1997 Spickler
5,615,451 A 4/1997 Peterson et al.
5,628,522 A 5/1997 Hall
5,628,523 A 5/1997 Smith
5,636,649 A 6/1997 Horvath
5,730,668 A 3/1998 Hege et al.
5,743,283 A 4/1998 Horvath
5,823,213 A 10/1998 Patarra
5,826,850 A 10/1998 Goldsmith
5,839,714 A 11/1998 Fitzsimmons et al.
5,843,556 A 12/1998 Levas
5,865,541 A 2/1999 Lafleur
5,871,148 A 2/1999 Hafer
D411,341 S 6/1999 Lee
D411,342 S 6/1999 Lee
5,940,932 A 8/1999 LaHay
5,957,145 A 9/1999 Plumer
5,964,533 A 10/1999 Ziglar
5,968,204 A 10/1999 Wise
5,979,793 A 11/1999 Louis
6,000,549 A 12/1999 Perkins
6,015,057 A 1/2000 Stone et al.
D426,985 S 6/2000 Casalino
6,089,394 A 7/2000 Ziglar
6,102,569 A 8/2000 Wang
6,105,305 A 8/2000 Edens
6,109,786 A 8/2000 Hafer et al.
6,113,054 A 9/2000 Ma
6,113,270 A 9/2000 Hafer
6,149,025 A 11/2000 Wang
6,196,719 B1 3/2001 Brown
6,203,198 B1 3/2001 Stone
6,220,755 B1 4/2001 Brown et al.
6,230,724 B1 5/2001 Lai
6,305,659 B1 10/2001 Metelski
6,328,470 B2 12/2001 Brown et al.
6,336,450 B1 1/2002 Collet
6,367,494 B1 4/2002 Tung
6,374,839 B2 4/2002 Patarra
6,405,990 B2 6/2002 Davis et al.
6,412,746 B2 7/2002 Davis et al.
6,412,747 B2 7/2002 Davis et al.
6,415,927 B1 7/2002 Stone et al.
6,446,408 B1 9/2002 Gordin et al.
6,446,930 B1 9/2002 Li
D464,190 S 10/2002 Salahub
6,481,591 B2 11/2002 Mendoza et al.
6,488,254 B2 12/2002 Li
6,511,033 B2 1/2003 Li
D470,305 S 2/2003 Clarke
6,523,640 B1 2/2003 Young et al.
6,554,012 B2 4/2003 Patarra
6,554,243 B2 4/2003 Davis et al.
6,565,060 B2 5/2003 Li et al.
6,585,219 B2 7/2003 Li
6,594,951 B1 7/2003 Reynolds
6,637,717 B2 10/2003 I i
D484,303 S 12/2003 Taylor
6,658,760 B2 12/2003 Kohlman et al.
6,669,045 B2 12/2003 Wang
D485,055 S 1/2004 Taylor
6,682,055 B1 1/2004 Tomlinson et al.
6,732,752 B2 5/2004 Cohen et al.
6,796,319 B1 9/2004 Patarra et al.
6,869,058 B2 3/2005 Tung
6,877,708 B1 4/2005 Thurner
6,889,953 B2 5/2005 Harbough
D516,297 S 3/2006 Smith et al.
7,090,399 B2 8/2006 Godshaw et al.
7,140,581 B1 11/2006 White
7,143,601 B1 12/2006 Jimenez
7,163,212 B1 1/2007 Rupp
7,195,397 B2 3/2007 Williamson et al.
7,216,839 B2 5/2007 Xiaoqiu
7,285,111 B2 10/2007 Gaster
7,331,684 B2 2/2008 Tung
7,347,428 B2 3/2008 Edenso
D568,603 S 5/2008 Smith et al.
D573,786 S 7/2008 Smith et al.
D574,143 S 8/2008 Smith et al.
D578,749 S 10/2008 Ng
7,431,259 B2 10/2008 Tung
7,484,704 B2 2/2009 Schommertz
7,503,541 B2 3/2009 Harold et al.
7,513,479 B2 4/2009 Li
7,520,485 B1 4/2009 Giannetto
7,537,015 B1 5/2009 Molnar, IV et al.
7,575,117 B2 8/2009 Redzisz et al.
7,584,563 B2 9/2009 Hillstrom et al.
7,600,734 B2 * 10/2009 Clarke ..... A45B 25/00 135/120.3
7,600,917 B2 10/2009 Richardson, Jr.
7,614,600 B1 11/2009 Smith et al.
7,641,165 B2 1/2010 Li
7,644,903 B2 1/2010 Amato et al.
D612,146 S 3/2010 Clarke
D617,041 S 6/2010 Shi
7,753,546 B2 7/2010 Kuelbs
D621,148 S 8/2010 Brady
D621,149 S 8/2010 Brady
7,780,139 B2 * 8/2010 Markert ..... E04H 12/2261 248/523

(56) References Cited

U.S. PATENT DOCUMENTS

| | | | | |
|---|---|---|---|---|
| 7,784,761 | B2 | 8/2010 | Ma | |
| D625,528 | S | 10/2010 | Sprague | |
| 7,836,902 | B2 * | 11/2010 | Tung | A45B 23/00 135/20.3 |
| 7,891,633 | B2 | 2/2011 | Li | |
| 7,958,901 | B2 | 6/2011 | Lai | |
| 8,070,006 | B2 | 12/2011 | Austin et al. | |
| 8,104,492 | B2 | 1/2012 | Dan | |
| D655,531 | S | 3/2012 | Gharst | |
| D668,443 | S | 10/2012 | Sims, II | |
| D677,075 | S | 3/2013 | Rodgers | |
| 8,485,757 | B2 | 7/2013 | Nomoto | |
| 8,522,804 | B1 | 9/2013 | Tung | |
| D691,839 | S | 10/2013 | Dallenbach | |
| 8,556,100 | B2 | 10/2013 | Austin et al. | |
| 8,567,729 | B2 | 10/2013 | Nemish | |
| D697,705 | S | 1/2014 | Ma | |
| 8,632,045 | B2 | 1/2014 | Ma | |
| 8,657,246 | B2 | 2/2014 | Ma | |
| 8,672,287 | B2 * | 3/2014 | Li | E04H 12/2246 248/519 |
| 8,714,511 | B2 | 5/2014 | Zoeteman | |
| 8,807,513 | B2 * | 8/2014 | Volin | A45B 17/00 248/521 |
| 8,833,709 | B2 | 9/2014 | Weng | |
| 8,894,281 | B2 | 11/2014 | Town et al. | |
| 8,919,361 | B2 | 12/2014 | Ma | |
| 8,919,722 | B2 | 12/2014 | Ma | |
| D722,796 | S | 2/2015 | Lievore | |
| 8,960,625 | B2 | 2/2015 | Ma | |
| D724,309 | S | 3/2015 | Ma | |
| 9,038,325 | B1 | 5/2015 | Callahan | |
| D732,817 | S | 6/2015 | Elstow | |
| D740,546 | S | 10/2015 | DeVaney | |
| 9,271,550 | B2 * | 3/2016 | Xiong | A45B 23/00 |
| D761,601 | S | 7/2016 | Simmons | |
| D768,978 | S | 10/2016 | Ma | |
| D771,935 | S | 11/2016 | Ma | |
| D775,461 | S | 1/2017 | Ma | |
| 9,540,840 | B2 | 1/2017 | Ma | |
| D785,380 | S | 5/2017 | King | |
| D817,631 | S | 5/2018 | Weng | |
| 9,957,728 | B2 | 5/2018 | Ma | |
| D833,136 | S | 11/2018 | Ma | |
| D855,967 | S | 8/2019 | Ma | |
| 11,365,557 | B2 | 6/2022 | Ma | |
| 2001/0013358 | A1 | 8/2001 | Patarra | |
| 2001/0032916 | A1 * | 10/2001 | Wess | F16M 11/18 248/349.1 |
| 2001/0040208 | A1 | 11/2001 | Li | |
| 2001/0045498 | A1 | 11/2001 | Davis et al. | |
| 2002/0023995 | A1 * | 2/2002 | Yoshida | B60N 2/14 248/425 |
| 2002/0185582 | A1 | 12/2002 | Li | |
| 2003/0145498 | A1 | 8/2003 | Venegas, Jr. | |
| 2003/0156891 | A1 * | 8/2003 | Hung | F16C 11/10 403/84 |
| 2003/0230692 | A1 | 12/2003 | Davis et al. | |
| 2004/0056169 | A1 | 3/2004 | Harbough | |
| 2004/0069922 | A1 | 4/2004 | Wu | |
| 2004/0108439 | A1 | 6/2004 | Ma | |
| 2004/0129854 | A1 * | 7/2004 | Schmitz | A47G 33/1213 248/523 |
| 2004/0163336 | A1 | 8/2004 | Hsu | |
| 2004/0177871 | A1 | 9/2004 | Harbough | |
| 2004/0195487 | A1 | 10/2004 | Harbough | |
| 2005/0023428 | A1 | 2/2005 | Woude et al. | |
| 2005/0161067 | A1 | 7/2005 | Hollins | |
| 2005/0189005 | A1 | 9/2005 | Smith et al. | |
| 2006/0054206 | A1 | 3/2006 | Bilotti | |
| 2006/0102822 | A1 * | 5/2006 | Liang | G09F 17/00 248/514 |
| 2007/0080277 | A1 | 4/2007 | Chen | |
| 2008/0093528 | A1 * | 4/2008 | Tsai | F16M 11/08 248/349.1 |
| 2008/0111046 | A1 | 5/2008 | Tung | |
| 2009/0174162 | A1 | 7/2009 | Gass et al. | |
| 2009/0314912 | A1 * | 12/2009 | Whitley | F16M 11/16 248/299.1 |
| 2009/0320341 | A1 | 12/2009 | Hillstrom et al. | |
| 2010/0050706 | A1 * | 3/2010 | O'Neill | F16M 11/08 70/58 |
| 2010/0065709 | A1 | 3/2010 | Ying | |
| 2010/0147341 | A1 | 6/2010 | Li | |
| 2010/0206346 | A1 | 8/2010 | Tung | |
| 2011/0232704 | A1 | 9/2011 | Li | |
| 2012/0024330 | A1 | 2/2012 | Ma | |
| 2012/0025050 | A1 | 2/2012 | Ma | |
| 2012/0126388 | A1 | 5/2012 | Kuo | |
| 2013/0134285 | A1 | 5/2013 | Weng | |
| 2013/0146739 | A1 | 6/2013 | Zhao | |
| 2014/0230866 | A1 | 8/2014 | Paolucci | |
| 2014/0263926 | A1 | 9/2014 | LeAnna | |
| 2015/0076313 | A1 | 3/2015 | Ma | |
| 2017/0114563 | A1 | 4/2017 | Ye | |
| 2019/0063103 | A1 | 2/2019 | Siegenthaler | |
| 2019/0090964 | A1 | 3/2019 | Rosenberg | |
| 2019/0281720 | A1 * | 9/2019 | Jean | F16C 11/04 |
| 2019/0301670 | A1 * | 10/2019 | Glickstein | F16M 13/022 |
| 2020/0208429 | A1 | 7/2020 | Ma | |

FOREIGN PATENT DOCUMENTS

| | | |
|---|---|---|
| DE | 2020 1710 2218 U1 | 6/2017 |
| EP | 0 060 957 | 9/1982 |
| EP | 0 818 594 | 1/1998 |
| EP | 0 822 305 | 2/1998 |
| EP | 2 565 350 B1 | 12/2014 |

OTHER PUBLICATIONS

Treasure Garden, 2010 Product Catalog.

Extended European Search Report issued in European Patent Application No. 14185666.6, dated Jun. 24, 2015.

AMBIENTE The XXL Free-Arm Sunshade, Glatz AG, believed to be published by Jan. 1, 2017, in 6 pages.

Sonnenschirm Akzento®, Montage- und Gebrauchsanleitung Akzento®, Glatz AG, believed to be published in 2005 in 16 pages.

* cited by examiner

ROTATION BASE FOR UMBRELLA

CROSS REFERENCE

Any and all applications for which a foreign or domestic priority claim is identified in the Application Data Sheet as filed with the present application are hereby incorporated by reference under 37 CFR 1.57.

BACKGROUND

Field

This disclosure generally relates to umbrellas and particularly to large outdoor umbrellas.

Related Art

Large outdoor umbrellas can include a canopy assembly supported by an upright pole. The canopy assembly can include a canopy supported by a plurality of ribs and struts. The canopy can be used in outdoor spaces to provide protection from the sun, rain, and other environmental elements. Large outdoor umbrellas can be of a center pole or cantilevered type. Both umbrella types can include various features to facilitate positioning of the canopy (e.g., opening, closing, and/or tilting).

SUMMARY

In one aspect, an umbrella base, includes a first support coupled to a fixed base or ground support. The first support includes a plurality of enclosed apertures extending from a first opening on a top surface of the first support to a second opening on a bottom surface of the first support. A second support rotatably couples to the first support. An actuator pivotably couples to the second support. The actuator includes a foot pedal disposed at a first end and pin disposed at a second end of the actuator opposite the foot pedal. The pin has a free end disposed away from the second end of the actuator and a fixed end coupled to the second end of the actuator. A spring is between the foot pedal and the first support. The spring biases the pin into any one of the plurality of enclosed apertures. Depression of the foot pedal retracts the pin from any one of the plurality of enclosed apertures.

In another aspect, the actuator has a removable clip coupled to the second end of the actuator. The removable clip includes a slot receive the fixed end of the pin.

In another aspect, the second support has a slot that surrounds the pin in at least a locked configuration.

In another aspect, first support has an open aperture formed in an outer periphery between two adjacent enclosed apertures. The open aperture receives the pin.

In another aspect, the pin has a narrowed region adjacent to the free end.

In another aspect, the pin has a tapered surface in a middle section of the pin.

In another aspect, the enclosed apertures comprise a tapered surface extending from the first opening toward the second opening, the tapered surface of the enclosed apertures engage the tapered surface in the middle section of the pin.

In another aspect, the fixed end of the pin has a notch.

In another aspect, the second end of the actuator has a correspondingly shaped slot to receive the notch of the fixed end of the pin.

In another aspect, the second end of the actuator has a removable clip hat includes the notch-shaped slot.

In another aspect, the actuator has a ring shaped body disposed between the first end and the second end thereof. The clip is secured to an inner periphery of the ring shaped body.

In another aspect, the clip has a first surface, a second surface opposite the first surface, and a gap disposed therebetween, the gap receive a span of the ring shaped body.

In another aspect, the gap faces radially outwardly and the clip encloses a radially inward side of the span of the ring shaped body.

In another aspect, the actuator has a ring shaped body disposed between the first end and the second end thereof.

In another aspect, includes an umbrella pole mount, wherein the ring-shaped body surrounds the umbrella pole mount.

In another aspect, the pin is coupled to a span of the ring-shaped body opposite the foot pedal.

In another aspect, a clip coupled to the pin. The clip has a gap to receive a span of the ring shaped body.

In another aspect, the clip is positioned between the span of the ring shaped body and the umbrella pole mount such that clip is retained on the second end of the actuator.

In one aspect, the umbrella base, includes a first support coupled to a fixed base or ground support. The first support includes a plurality of apertures extending from an opening on a surface of the first support. A second support rotatably coupled to the first support. An actuator pivotably coupled to the second support. The actuator includes a controller disposed at a first end. A pin assembly disposed at a second end of the actuator opposite the controller. The pin assembly includes a pin having a free end disposed away from the second end of the actuator and a fixed end secured to the second end of the actuator by a clip. The controller is retract the pin from any one of the plurality of apertures. The pin is insertable into any one of the plurality of apertures.

In another aspect, the clip has a slot. The slot receives a notch on the fixed end of the pin.

In another aspect, the clip is secured to an inner periphery of the actuator between the inner periphery and the umbrella pole mount such that the clip is retained on the second end of the actuator.

In another aspect, the pin extends through a slot in the second support and into any one of the plurality of apertures of the first support to prevent the umbrella base from rotating.

In another aspect, the slot is oriented in a direction transverse to the rotational axis of the second support.

In another aspect, the slot in the second support has a length and a width. The length being greater than a diameter of the pin such that the pin can move along the slot along an arc as the second end of the actuator pivots with respect to the second support.

The foregoing summary is illustrative only and is not intended to be limiting. Other aspects, features, and advantages of the systems, devices, and methods and/or other subject matter described in this application will become apparent in the teachings set forth below. The summary is provided to introduce a selection of some of the concepts of this disclosure. The summary is not intended to identify key or essential features of any subject matter described herein

BRIEF DESCRIPTION OF THE DRAWINGS

Various examples are depicted in the accompanying drawings for illustrative purposes, and should in no way be interpreted as limiting the scope of the examples. Various features of different disclosed examples can be combined to form additional examples, which are part of this disclosure.

DETAILED DESCRIPTION

The various features and advantages of the systems, devices, and methods of the technology described herein will become more fully apparent from the following description of the examples illustrated in the figures. These examples are intended to illustrate the principles of this disclosure, and this disclosure should not be limited to merely the illustrated examples. The features of the illustrated examples can be modified, combined, removed, and/or substituted as will be apparent to those of ordinary skill in the art upon consideration of the principles disclosed herein.

Umbrella Assembly

Figure 1:
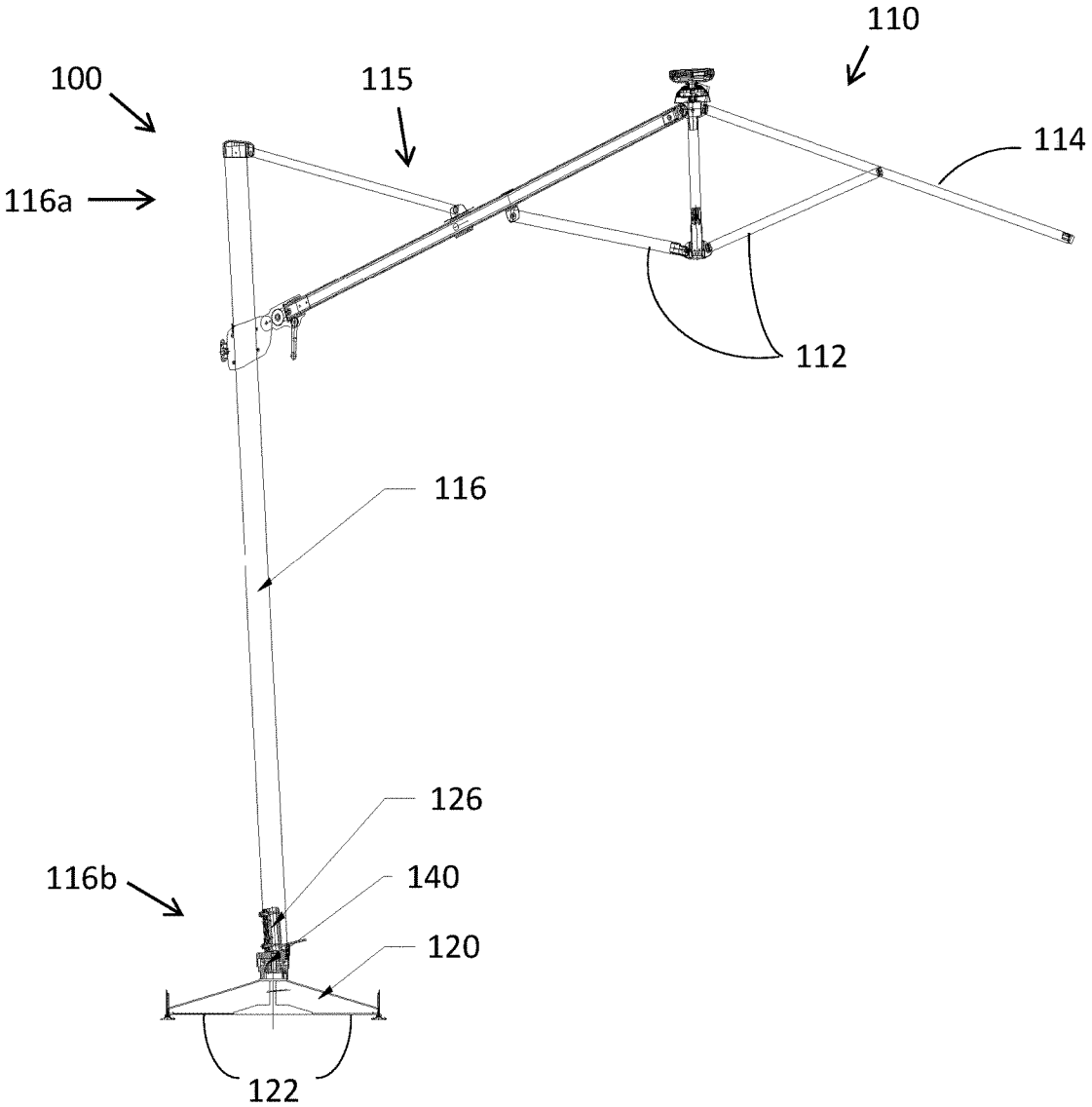
FIG. 1 is an elevation view of an umbrella assembly.

FIG. 1 illustrates an umbrella assembly 100. The umbrella assembly 100 can be a cantilever type umbrella assembly. The umbrella assembly 100 can include a canopy assembly 110. The canopy assembly 110 can include a plurality of struts 112 and/or ribs 114. The struts and ribs 112, 114 can support a canopy (not shown). The canopy can be a fabric or other suitable structure for providing shade or shelter thereunder. In an open configuration, the canopy assembly 110 can provide shade and protection from environmental elements. The canopy assembly 110 can be coupled to an upright pole 116. The canopy assembly 110 can be coupled to the upright pole 116 by a transverse member, such as a boom 115. The upright pole 116 can include an upper end 116*a* and a lower end 116*b*. The canopy assembly 110 can be coupled to the upright pole 116, e.g., by the boom 115 or directly in a configuration in which the pole 116 directly supports the canopy assembly 110 from directly below. The lower end 116*b* of the upright pole 116 can be coupled to a base assembly 120.

The base assembly 120 can include a mount 126. The mount 126 is configured to support an umbrella stem or an umbrella pole. The mount 126 can couple to the lower end 116*b*. The lower end 116*b* can include a hollow portion for receiving the mount 126. The mount 126 can be a tubular cylinder. The mount 126 can include a flange on a lower end for assembly with the base assembly 120 (e.g., by one or more mechanical fasteners).

The base assembly 120 can include one or more support members 122. The support members 122 can project outwardly from a center of the base assembly 120. The supports members 122 can project radially outwardly from the center of the base assembly 120 (e.g., hub and spoke). The support members 122 can enhance the stability of the umbrella assembly 100. In one embodiment, the support members 122 support a housing that can enclose structural components of the base assembly 120, e.g., a plate configured to be bolted to a ground surface.

It can be desirable to change the orientation of the canopy assembly 110 (e.g., to accommodate movement of one or more user or the sun). However, cantilever type umbrellas, like the umbrella assembly 100, can be difficult to maneuver because of the configuration of the boom 115, the weight to be moved and other considerations. One solution to this problem is to rotate the canopy assembly 110, the boom 115, and the upright pole 116 about a vertical axis that extends vertically through the base assembly 120. Various rotation mechanisms exist; however, these rotation mechanisms can be cumbersome to operate, difficult to repair, and/or expensive to manufacture. Accordingly, there is a need for an improved base assembly 120 to facilitate rotation of the canopy assembly 110.

Actuator Assembly

The base assembly 120 can include an actuator assembly 140. The actuator assembly 140 can be operable by a user to enable and disable rotation of the upright pole 116 relative to the base assembly 120.

Figure 2:
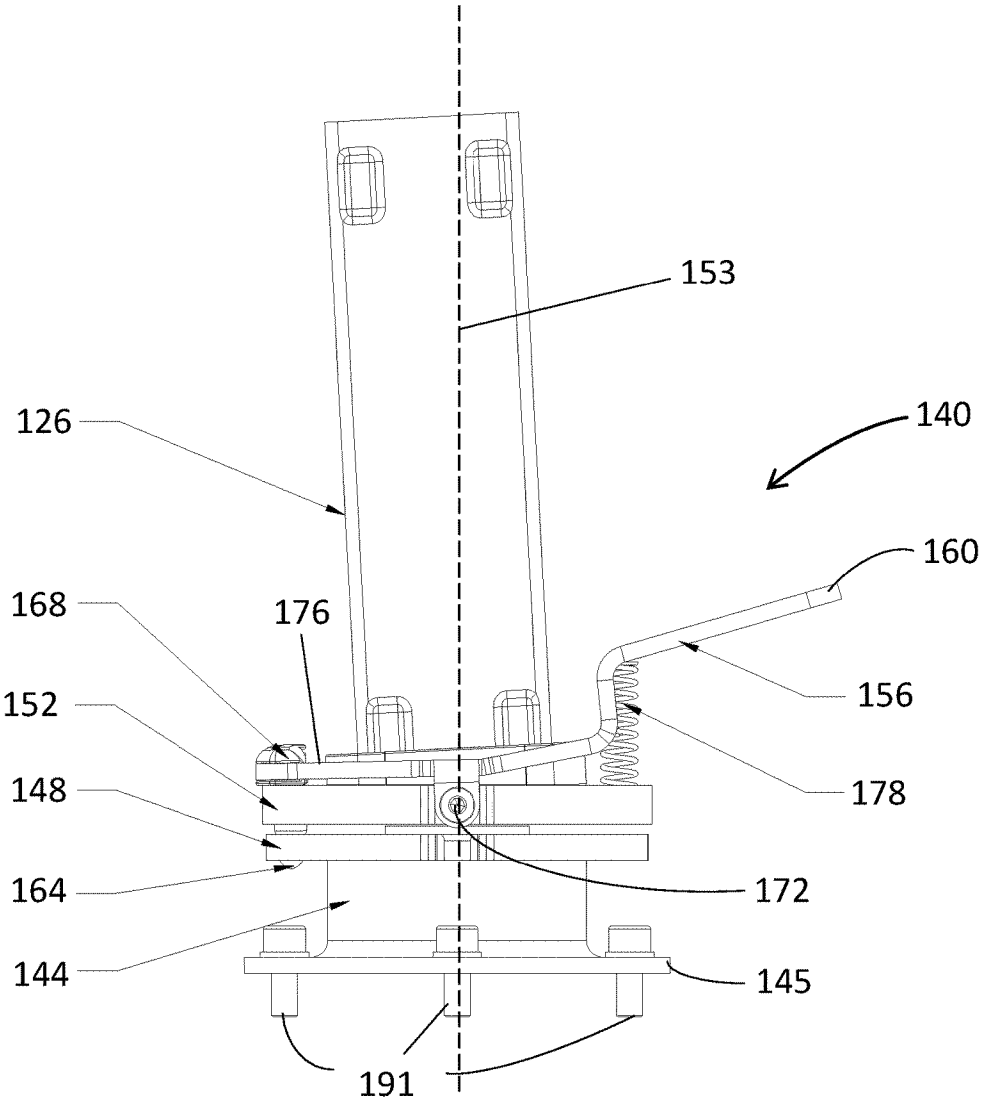
FIG. 2 is an elevation view of an actuator assembly of the umbrella assembly of FIG. 1 showing the actuator assembly in a locked configuration.

FIG. 2 further illustrates the actuator assembly 140. The actuator assembly 140 can include a base support 144. The base support 144 can include a lower flange 145. The lower flange 145 can include a plurality of apertures therein (e.g., around an outer periphery thereof) for receiving a respective plurality of bolts 191. The bolts 191 can couple to the support members 122 (not shown) through one or more frame members (not shown) of the base assembly 120 to support the actuator assembly 140 relative to a ground surface. The base support 144 can securely couple the actuator assembly 140 with the base assembly 120 (e.g., by the bolts 191 and/or other mechanical fasteners).

The base support 144 can couple to a lower support 148 of the actuator assembly 140. The lower support 148 can include or can be a planar flange. The lower support 148 can be rigidly coupled to the base support 144. The lower support 148 can be integrally formed with the base support 144.

The lower support 148 can support an upper support 152 of the actuator assembly. The upper support 152 can be rotatable relative to the lower support 148. The upper support 152 can be rotatable about a central axis 153 of the base assembly 120. The upright pole 116 can rotate about the central axis 153.

The upper support 152 can be coupled to the mount 126. The upper support 152 can be rigidly coupled to the mount 126. The mount 126 can rotate with the upper support 152 relative to the lower support 148 and/or the base support 144. The mount 126 can be coupled to the upper support 152 by one or more mechanical fasteners (not shown), by welding or by other joining method that is appropriate for the load conditions that are present.

The upper support 152 can couple to an actuator 156. The actuator 156 can be pivotably about a pivot 172 relative to the upper support 152. The actuator 156 can include a foot pedal 160. The actuator 156 can include a lock end 176. The foot pedal 160 and the lock end 176 can be on opposite ends of the actuator 156. The pivot 172 can be between the lock end 176 and the foot pedal 160. The pivot 172 can comprise one or more pivot members (e.g., pins, rods or other axle or member configured for efficient rotation).

The actuator assembly 140 can include a spring 178. The spring 178 can engage the upper support 152 on a lower end of the spring and the actuator 156 on an upper end of the spring. The upper end of the spring 178 can engage with the foot pedal 160. The foot pedal 160 can be biased away from the upper support 152 by the spring 178 (e.g., upwardly). The lock end 176 can be biased into engagement with the upper support 152 by the spring 178 (e.g., downwardly).

The lock end 176 can include or can be coupled with an assembly that includes a pin 164. The lock end 176 can be directly connected to the pin 164. The pin 164 can be or can include an elongate member. The pin 164 can include a head or fixed end 164*b* and free end 164*a*. The free end 164*a* can extend from the lock end 176. The free end 164*a* can extend downwardly from the lock end 176 toward the lower support 148. The free end 164*a* can extend through the upper support 152 and into the lower support 148. The pin 164 can couple upper support 152 to the lower support 148. The pin 164 can function to lock the position of the upper support 152 with respect to the lower support 148 (e.g., to prevent or to limit rotation). The position of the pin 164 can be adjusted by the actuator 156.

In some examples, the pin 164 is separate from the actuator 156 and is attached thereto by a coupling device. For example, the actuator assembly 140 can include a clip 168. The clip 168 can mechanically couple to the lock end 176 of the actuator 156. The clip 168 can be removable from the lock end 176. The pin 164 can couple to the clip 168. The clip 168 can couple the pin 164 with the actuator 156 at the lock end 176.

Figure 3:
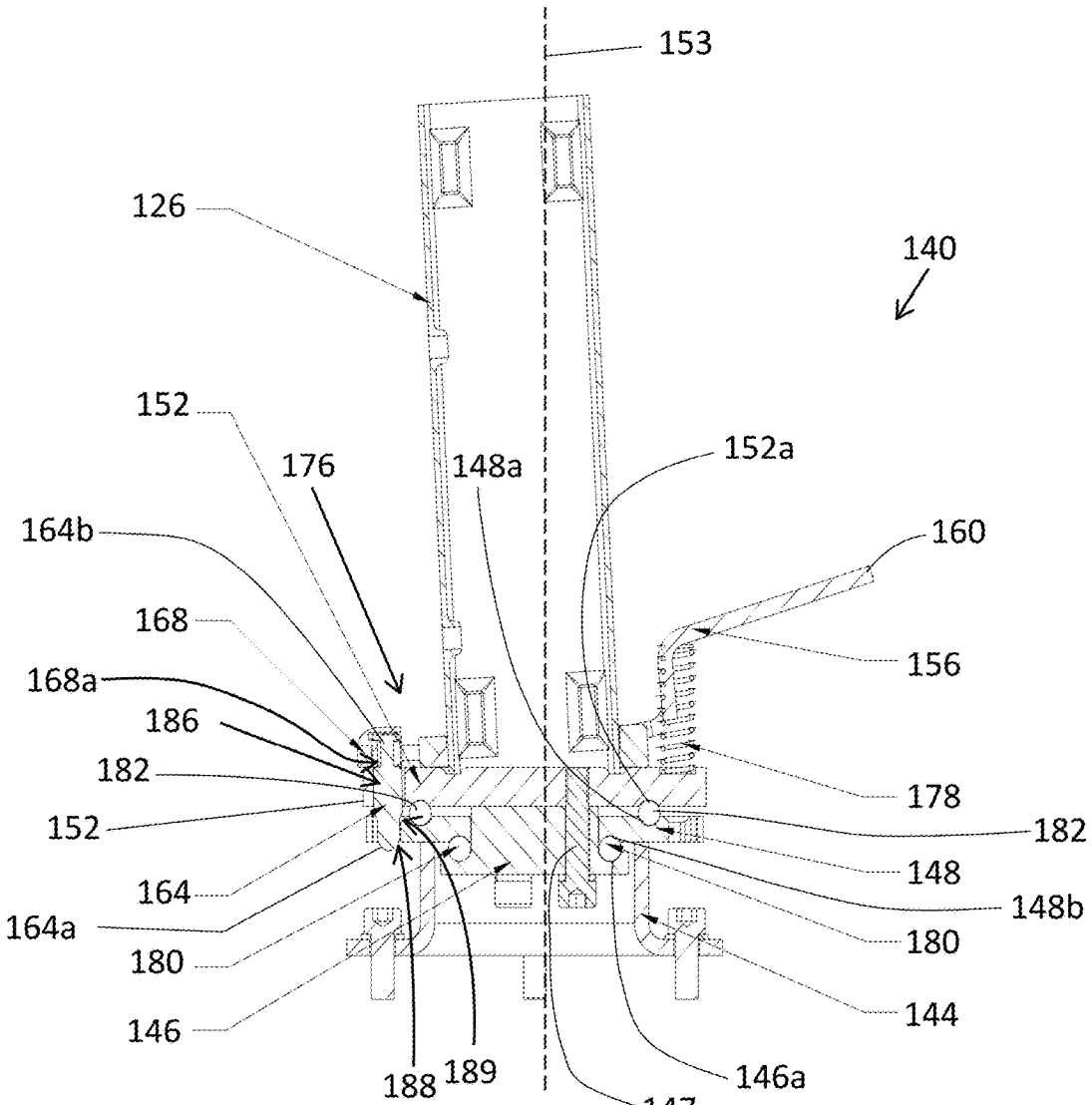
FIG. 3 is a cross-section view showing the configuration of the actuator assembly illustrated in FIG. 2.

With reference to FIG. 3, the actuator assembly 140 can include an inner support 146. The inner support 146 can rigidly couple to the upper support 152. The inner support 146 can be coupled to the upper support 152 by one or more mechanical fasteners 147. The inner support 146 can include a groove 146*a* for supporting a plurality of bearings 180. The bearings 180 can engage with a groove 148*b* of the lower support 148. The lower support 148 can be slidingly engaged with respect to the inner support 146 by the plurality of bearings 180.

The lower support 148 can include a groove 148*a*. The groove 148*a* can support a plurality of bearings 182. The plurality of bearings 182 can support the upper support 152. The upper support 152 can include a lower surface or groove 152*a*. The groove 152*a* engage with the bearings 182. The upper support 52 can be rotatable relative to the lower support 148 through the plurality of bearings 180, 182. The plurality of bearings 180 and the plurality of bearings 182 can be held in place by the assembly of the inner support 146 with the upper support 152 and the lower support 148 therebetween.

Figure 13:
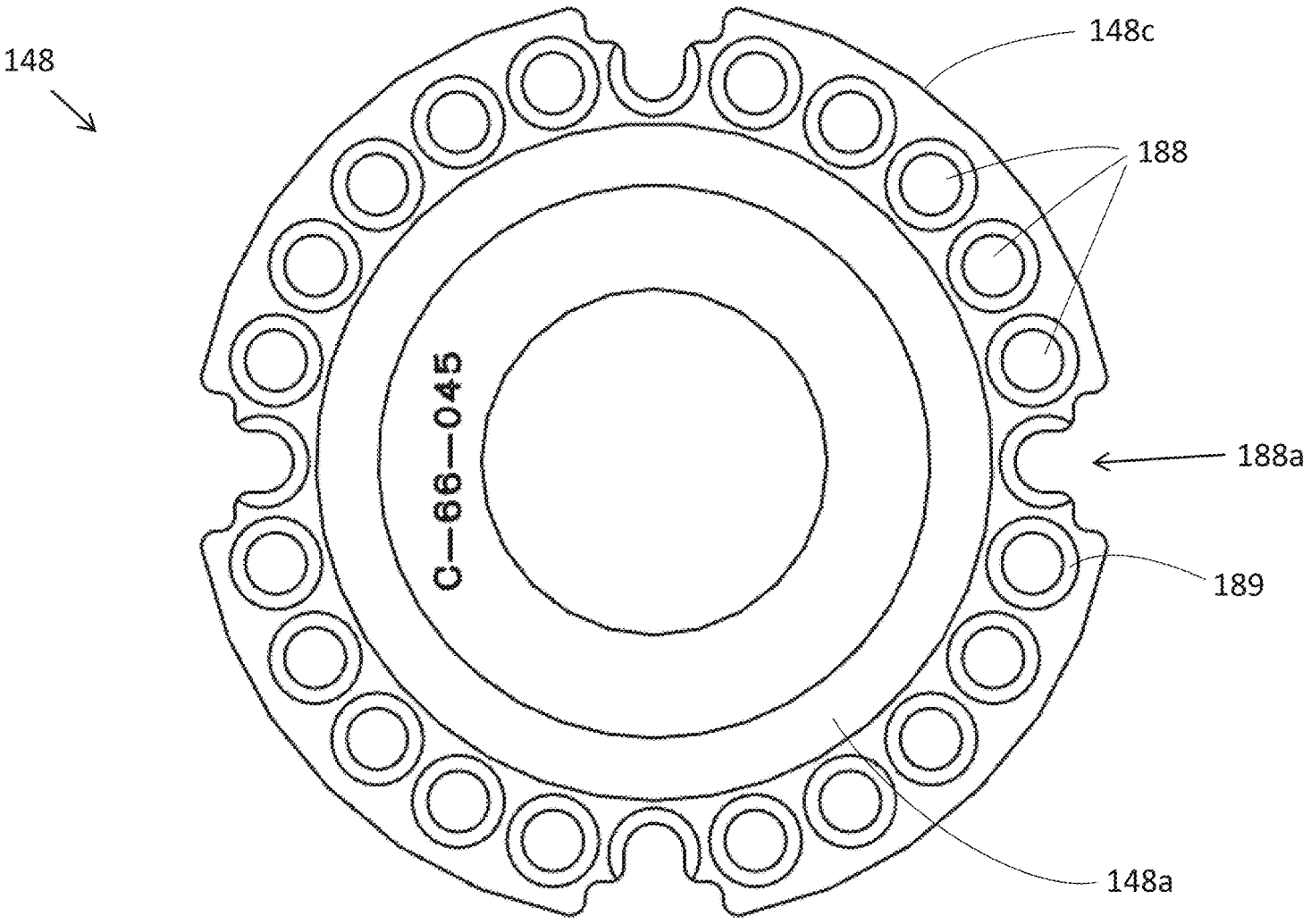
FIG. 13 is a top view of a second support, which can be a lower support of the actuator assembly of FIG. 2.

The pin 164 can include the free end 164*a*. The free end 164*a* can be received within an aperture 188 of the lower support 148. The aperture 188 can extend from an upper surface to a lower surface of the lower support 148 (e.g., through a thickness of the lower support 148). The aperture 188 can be one of a plurality of apertures 188, as shown in FIG. 13. The aperture 188 can be sized to receive the free end 164*a* of the pin 164. The aperture 188 can include a tapered surface or opening 189.

The pin 164 can include the fixed end 164*b*. The fixed end or head 164*b* can be coupled with the clip 168. The clip 168 can include a slot 168*a*. The slot 168*a* can be sized to receive the fixed end 164*b* of the pin 164. The head or fixed end 164*b* of the pin 164 can be mechanically engaged within the slot 168*a*. The fixed end 164*b* can be mechanically engaged within the slot 168*a* such that a movement of the pin 164 in at least one direction relative to the clip 168 is prevented. For example, the pin 164 can slide out of the slot 168*a* but is generally blocked by having one or more overlapping surfaces that overlap with overlapping surfaces of the clip 168. The overlapping surfaces can extend in a direction transverse to the axis 153. The overlapping surfaces can generally prevent movement of the pin 164 relative to the clip 168 in a direction parallel to or along the axis 153 but can allow motion transverse to the axis 153 when the clip 168 and the pin 164 are not assembled to the actuator 156.

The pin can include a body 164*c*. The body 164*c* can be between the free end 164*a* and the fixed end 164*b*. The body 164*c* can be coupled within the upper support 152. The upper support 152 can include an aperture 186. The aperture 186 can extend from an upper surface to a lower surface of the upper support 152 (e.g., through a thickness of the upper support 152). The free end 164*a* of the pin 164 can be located beneath the lower surface of the upper support 152, e.g., by extending all the way through the aperture 186. Engagement of the free end 164*a* within the aperture 188 and engagement of the fixed end 164*b* with the actuator 156 and/or the engagement of the body 164*c* with the aperture 186 can fix the rotation of the upper support 152 relative to the lower support 148.

The actuator assembly 140 can have a locked configuration and a rotation configuration. In the locked configuration, the pin 164 engages with the lower support 148 to fix the upper support 152 (and mount 126) with the lower support 148 (and base support 144). The actuator assembly 140 can be biased into the locked configuration by the spring 178 acting on the actuator 156. The spring 178 can apply a force on the foot pedal 160. The force can engage the pin 164 on the lock end 176 into the aperture 188 shown in FIG. 3 or any one of the apertures shown in FIG. 13.

Figure 4:
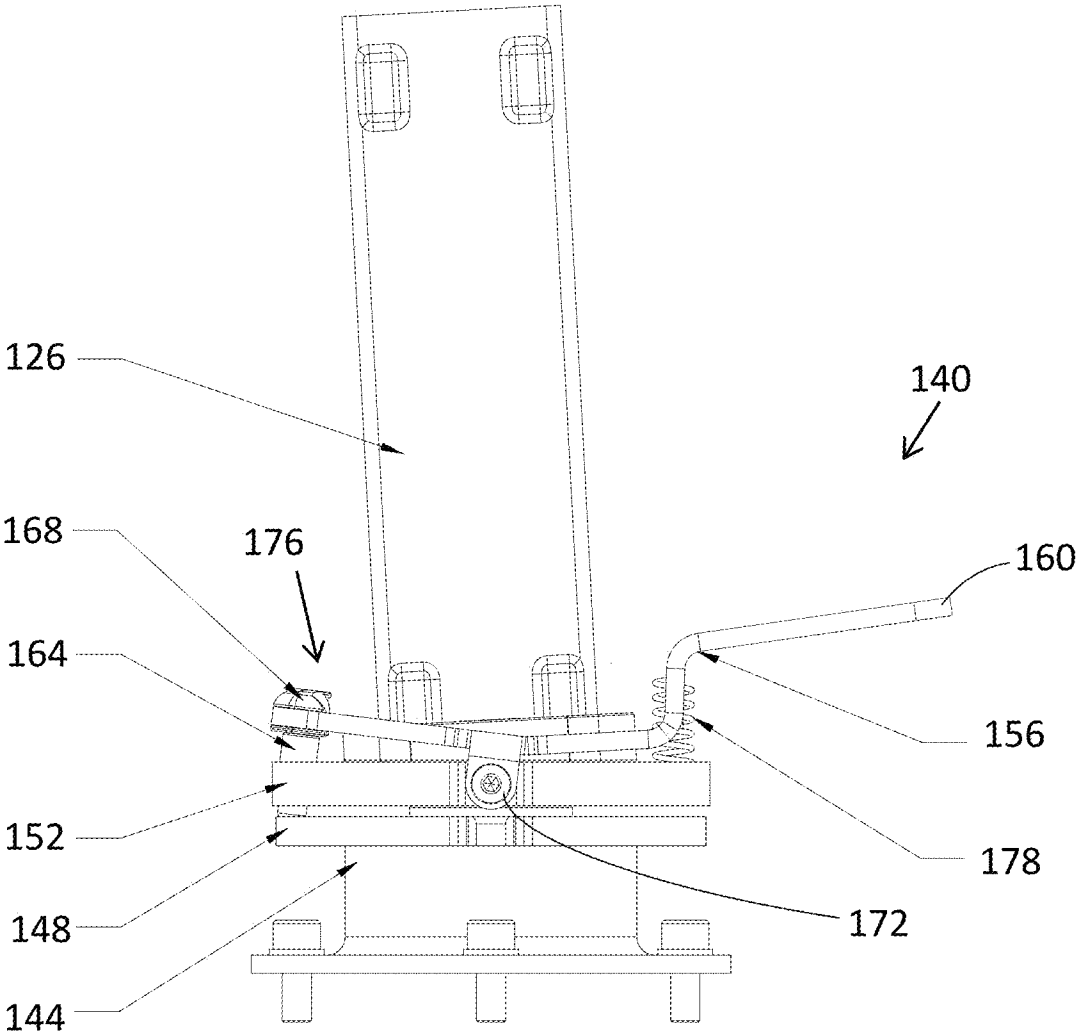
FIG. 4 is an elevation view of the actuator assembly of FIG. 2 in a rotation configuration.
Figure 5:
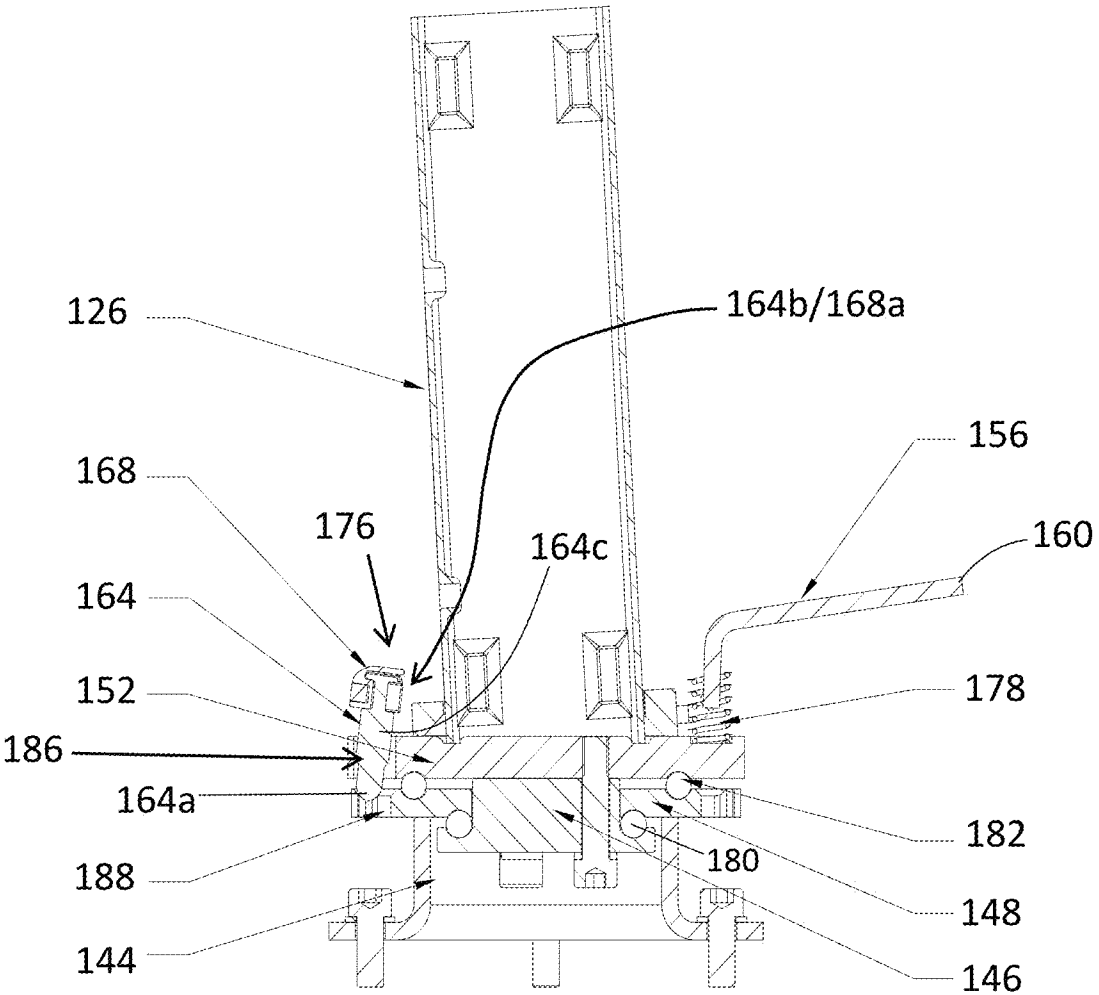
FIG. 5 is a cross-section view showing the configuration of the actuator assembly illustrated in FIG. 4.

FIGS. 4 and 5 show the actuator assembly 140 in a rotation configuration. In the rotation configuration, the foot pedal 160 is in a depressed position or configuration compared to the position of the foot pedal 160 in the locked configuration. In a depressed configuration, the spring 178 can be at least partially compressed. The depressed configuration for the foot pedal 160 can move the lock end 176 of the actuator 156 into a raised position or configuration. In the raised configuration, the lock end 176 can lift the free end 164*a* from the aperture 188 and/or the body 164*c* at least partially from the aperture 186. The removal of the pin 164 from engagement with the lower support 148 can enable rotation of the upper support 152 relative to the lower support 148. The rotation can be facilitated by the plurality of bearings 180 and/or the plurality of bearings 182.

Figure 6:
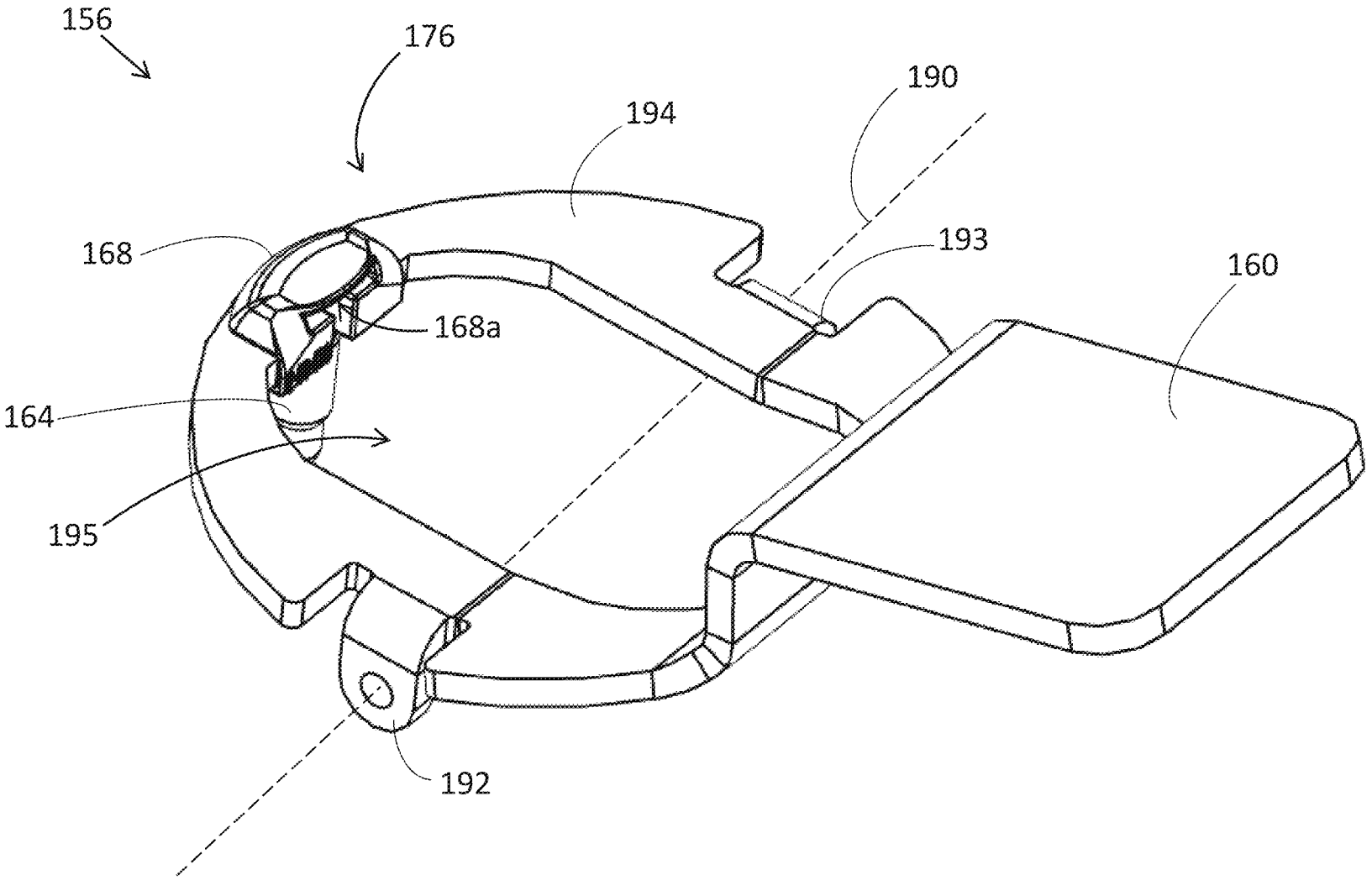
FIG. 6 is a perspective view of an actuator subassembly of the actuator assembly of FIG. 2.
Figure 7:
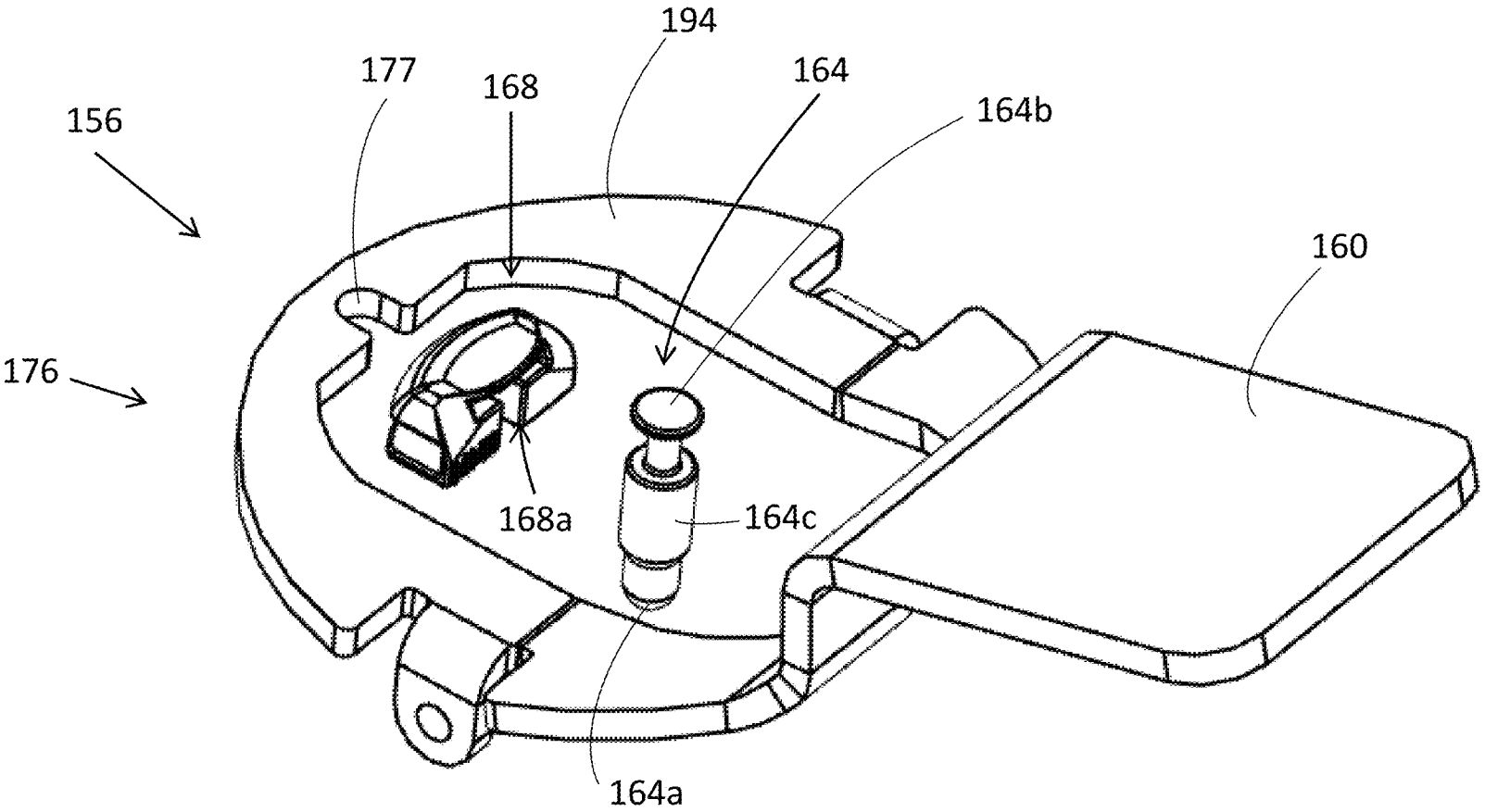
FIG. 7 is an exploded view of the actuator assembly of FIG. 6.

FIGS. 6-7 show further detail of the actuator assembly 140, including the actuator 156, the clip 168 and the pin 164. The actuator 156 can include the foot pedal 160. The foot pedal 160 can include a planar flange. The foot pedal 160 can include one or more grip enhancing elements (e.g., a rubber member, raised protrusions or the like) to assist the user in engaging the foot pedal 160.

The actuator 156 can include an actuator body 194. The actuator body 194 can be generally ring-shaped. The actuator body 194 can include a central aperture 195 (see FIG. 8). The central aperture 195 can be sized to receive or pass over the mount 126. The central aperture 195 can be surrounded by a radially inner periphery. The actuator body 194 can be angled relative to the foot pedal 160. The foot pedal 160 can be at an upward incline to the actuator body 194 such that a foot will engage the top surface of the pedal 160 at a position above a plane of the actuator body 194 which will be generally transverse to the axis 153, e.g., horizontal in some examples.

The actuator body 194 can include one or more flanges 192, 193. The flanges 192, 193 can be on opposite sides of the mount 126. The flanges 192, 193 can be oriented transverse to a plane of the body 194, e.g., can be bent portions of the body 194. The flanges 192, 193 can each include an aperture aligned along a pivot axis 190. The pivot axis 190 can be aligned with the pivot 172 (shown in FIG. 2). The foot pedal 160 and the lock end 176 can be offset from the pivot axis 190.

The lock end 176 can include the clip 168. The clip 168 can be removably coupled to the actuator body 196 at the lock end 176 of the actuator 156. The clip 168 can include the slot 168*a*. The actuator body 196 at the lock end 176 can include a cut-out 177. The cut-out 177 can align the clip 168 with the lock end 176. The cut-out 177 can prevent movement of the clip 168 relative to the lock end 176 in one or more directions, e.g., generally transverse or tangential to the actuator body 196.

Figure 8:
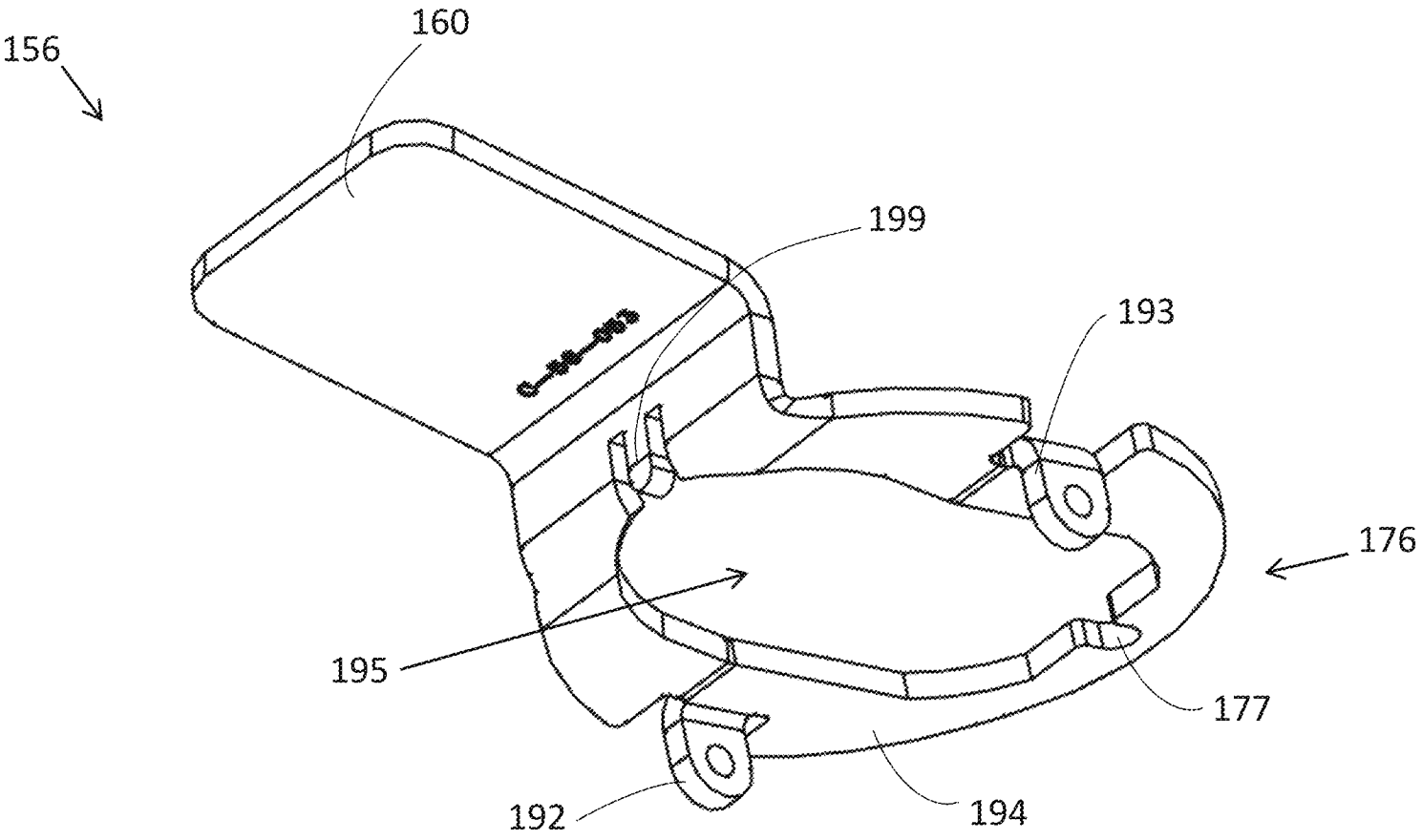
FIG. 8 is a bottom perspective view of an actuator of the actuator assembly of FIG. 6.

FIG. 8 shows a bottom perspective view of the actuator 156. The foot pedal 160 and/or the body 194 can include an extension 199. The extension 199 can be a narrow flange portion of the material of the actuator 156. The extension 199 can couple to the upper end of the spring 178. The extension 199 can be received within the upper end of the spring 178.

The actuator 156 can be formed from a single material, e.g., a single monolithic expanse of material. The single material can be a steel, aluminum, or other metallic sheet. The actuator 156 can be formed in part by a stamping process. The foot pedal 160, flanges 192, 193, the body 194, extension 199 and/or the aperture 195 can be formed in part by a bending process. The foot pedal 160, flanges 192, 193, the body 194, extension 199 and/or the aperture 195 by bent regions or cut-out portions of a single sheet of material.

Figure 9:
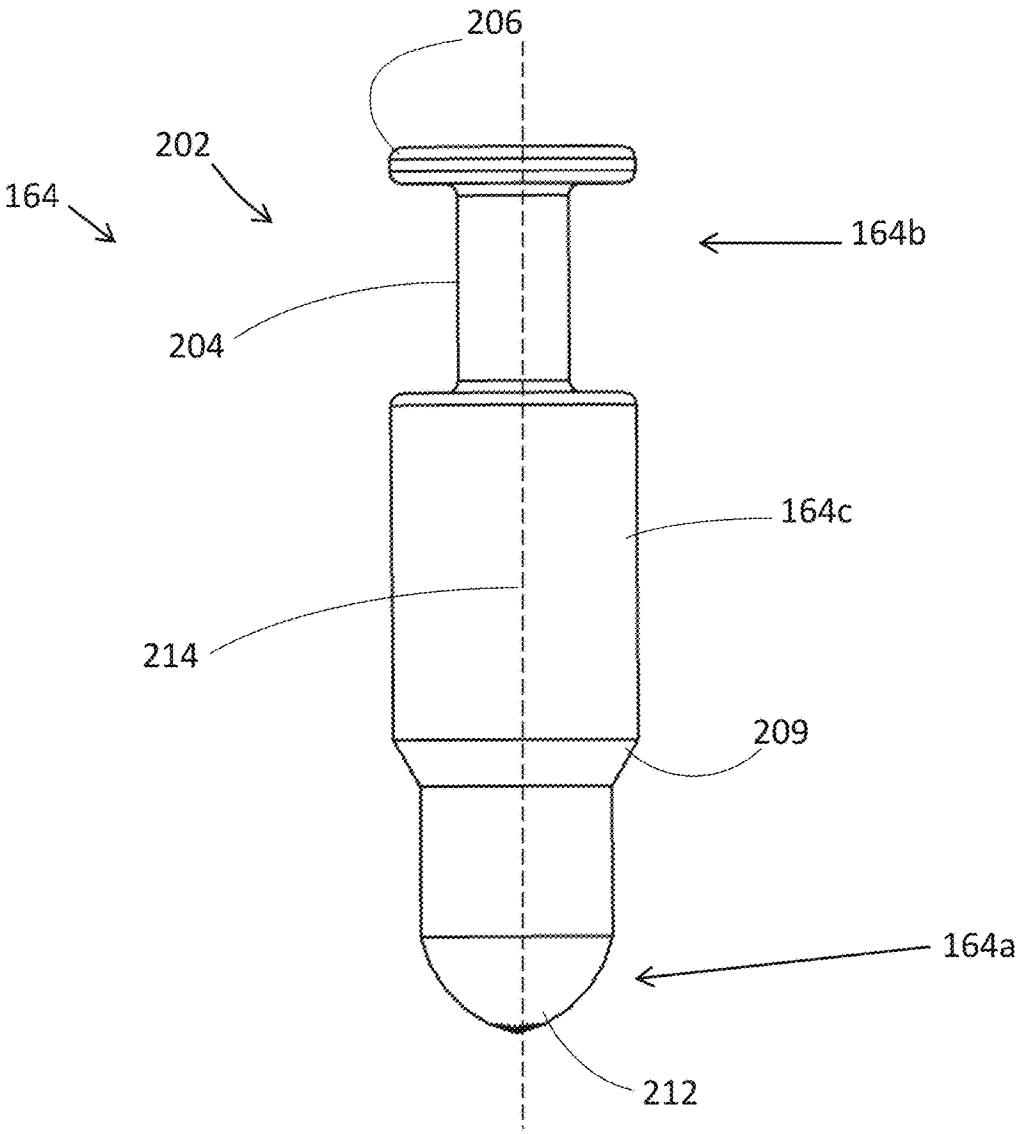
FIG. 9 is an elevation view of a pin of the actuator assembly of FIG. 6.

FIG. 9 shows an elevation view of the pin 164. The pin 164 can include a longitudinal axis 214. The pin 164 can include the fixed end 164*b*. The fixed end 164*b* can include a notch 202. The notch 202 can include or can be partly defined by an upper flange 206. The upper flange 206 can extend outwardly, e.g., can be an outwardly flared flange. The notch 202 can include or be partly defined by a narrow portion 204. The narrow portion 204 can be narrower than the upper flange 206 and/or the body 164*c* of the pin 164, as can be seen in the view of FIG. 9.

The body 164*c* can include a tapered portion 209. The tapered portion 209 can be a chamfer or fillet. The tapered portion 209 can taper from a larger diameter of the body 164*c* to a smaller diameter of the free end 164*a*. The free end 164*a* can include a rounded tip 212. The tapered portion 209 can interface with the tapered opening 189 of the aperture 188. The pin 164 can engage within the aperture 188, but due to manufacturing tolerances and/or inaccuracies, the interface of the pin 164 with the aperture 188 can have unwanted space, gap, or play. The tapered portion 209 and the tapered opening 189 can interface in a manner that reduces and/or eliminates the space, gap, or play. The free end 164*a* can be inserted into the aperture 188 until the tapered portion 209 contacts the tapered opening 189. Accordingly, the tapered portion 209 and the tapered opening 189 can reduce the play in the connection between the upper support 152 and the lower support 148 that results from the unwanted space. Overall this can reduce unwanted rotation of the umbrella 100 in the locked configuration.

Figure 10A:
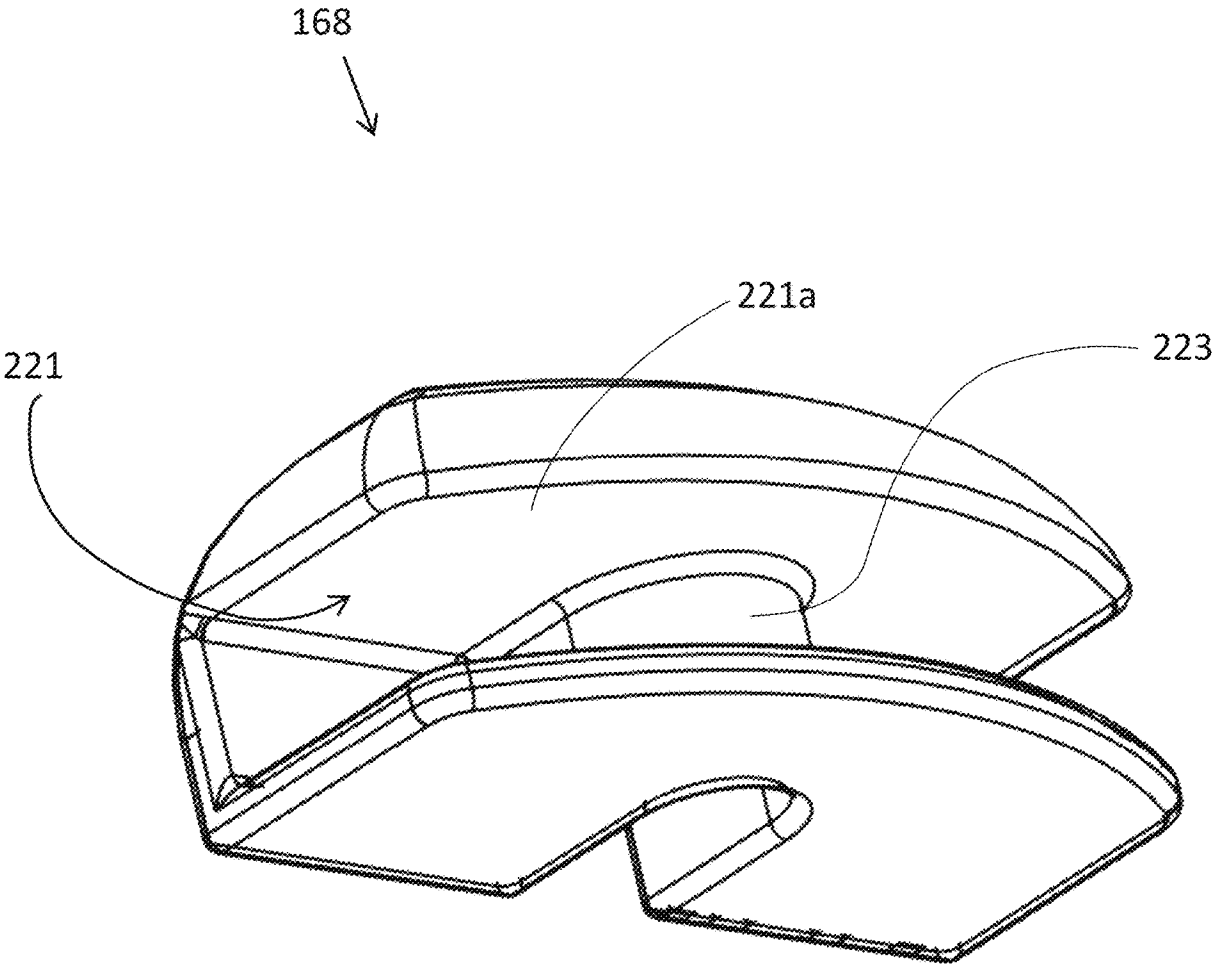
FIG. 10A is a perspective view of a clip of the actuator assembly of FIG. 6.
Figure 10B:
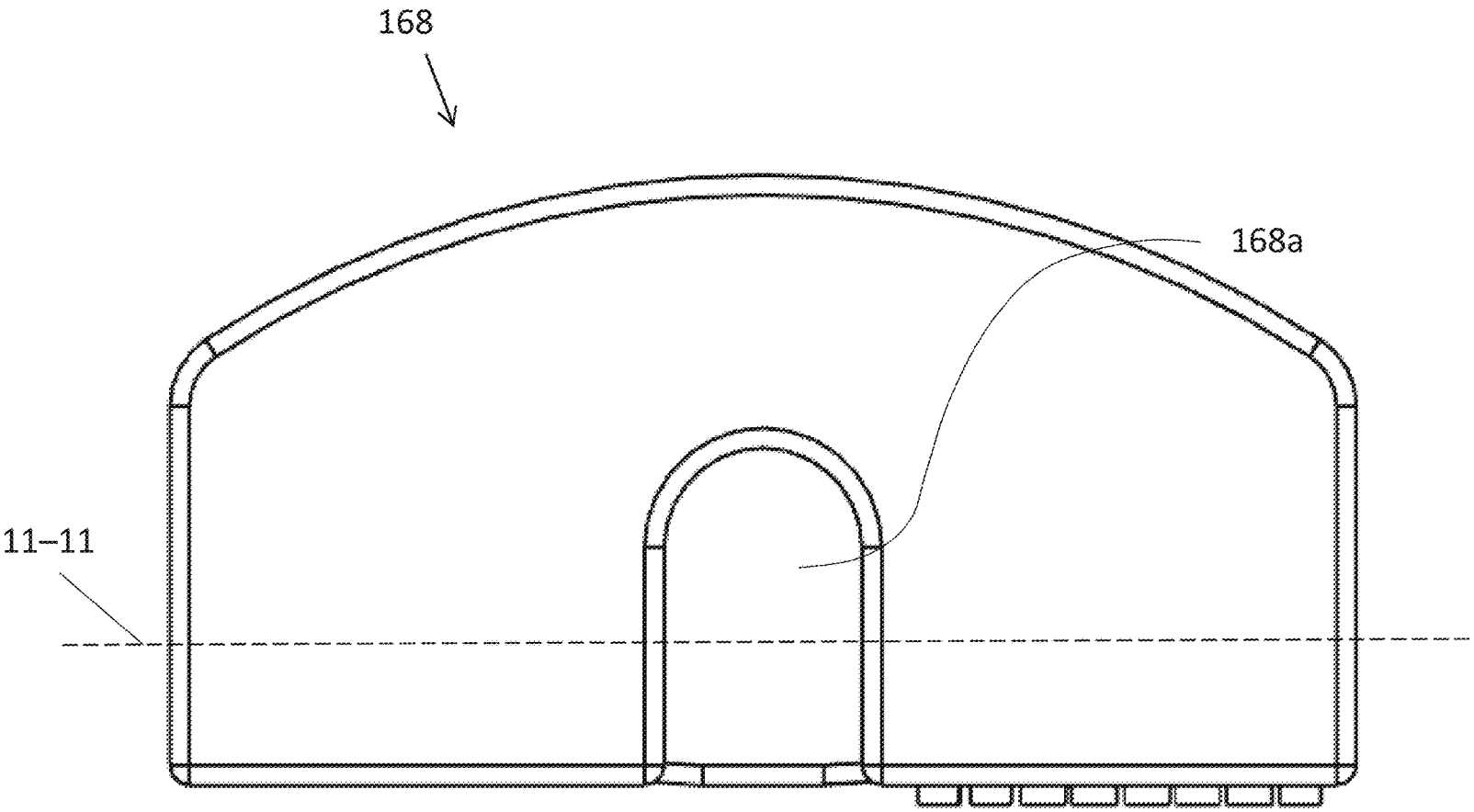
FIG. 10B is a bottom view of the clip of the actuator assembly of FIG. 6.
Figure 11:
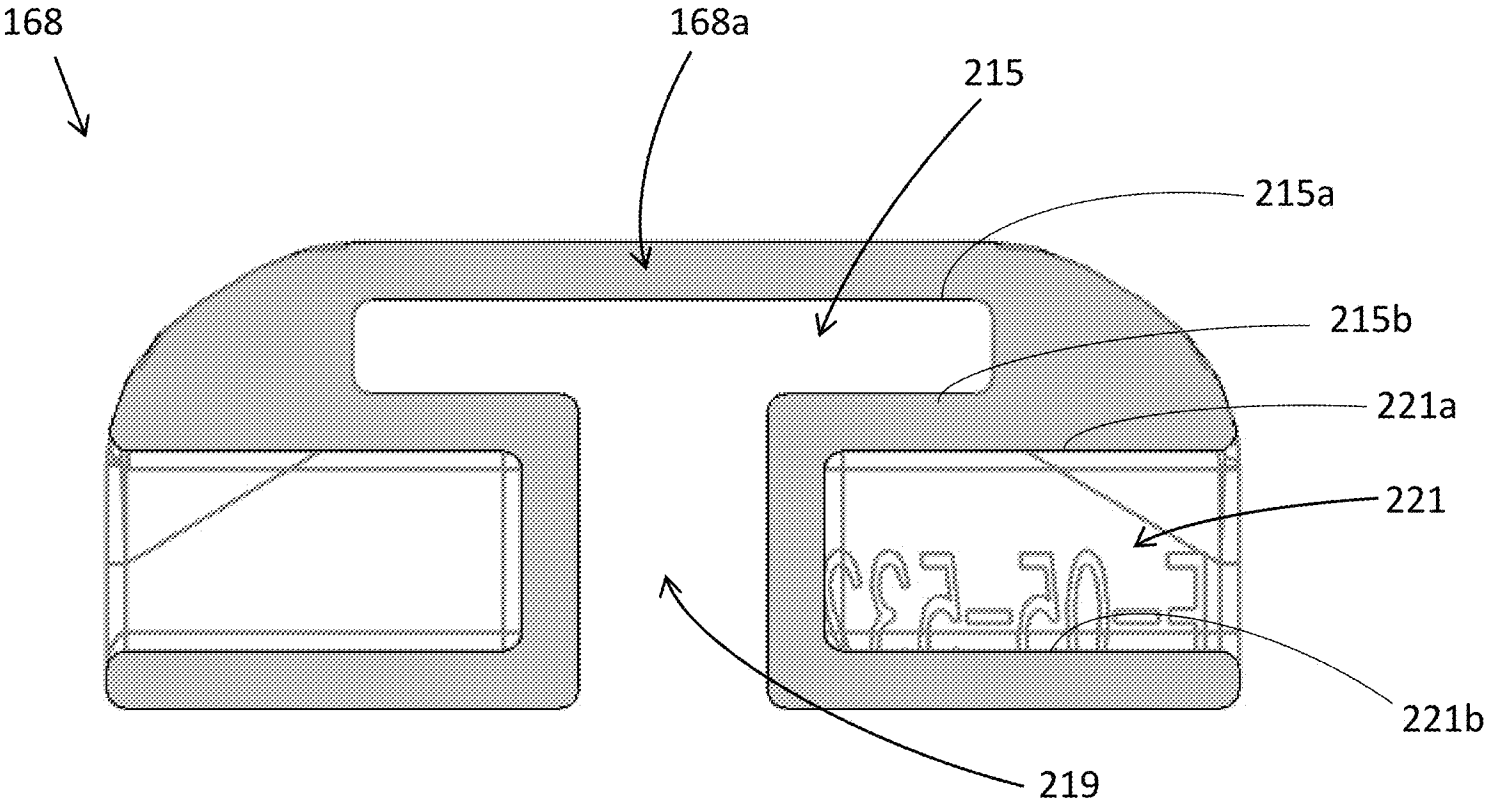
FIG. 11 is a cross-section view taken at section plane 11-11 shown in FIG. 10B.

As shown in FIGS. 10A-B and 11, the clip 168 can include a gap 221. The gap 221 can include an upper side 221*a* and a lower side 221*b*. The gap 221 can receive a span of the actuator body 194 at the lock end 176. The span the actuator body 194 can be received between the upper and lower sides 221*a*, 221*b*. The span the actuator body 194 can extend on one or more sides of the cut-out 177. The clip 168 can be assembled with the actuator body 194 at the lock end 176 in an outward or circumferential direction to place the span within the gap 221. The gap 221 can be faced outwardly from or away from the central aperture 195. The gap 221 can enclose a portion of the radially inner periphery aligned with the span the actuator body 194.

The clip 168 can include an outwardly curved portion 223. The curved portion 223 can disposed within the gap 221. The curved portion 223 can be outwardly curved with respect to the central aperture 195 when the clip 168 is coupled with the actuator body 194. The clip 168 can be assembled on the lock end 176 the actuator body 194 with the outwardly curved portion 223 disposed within the cut-out 177. The surface of the cut-out 177 can overlay the outer surface of the outwardly curved portion 223 such that relative movement of the clip 168 relative to the actuator body 196 at the lock end 176 is reduced, minimized or eliminated.

The slot 168*a* can be T-shaped. The slot 168*a* can include a widened region 215 and a narrow region 219. The widened region 215 can extend laterally of the narrow region 219. The widened region 215 can include upper and/or lower surfaces 215*a*, 215*b*. The upper and/or lower surfaces 215*a*, 215*b* can be generally orthogonal relative to a longitudinal axis of the narrow region 219. The slot 168*a* can receive the pin fixed end 164*b*. Together the narrow region 219 and the widened region 215 can form a T-shaped opening of the slot 168*a*, e.g., when the pin 164 has a T-shaped profile. The upper flange 206 of the notch 202 can be received within the widened region 215. The narrow portion 204 of the notch 202 can be received within the narrow region 219. The lower surface 215*b* can prevent removal of the fixed end 164*b* from the slot 168*a* in a least one direction. The at least one direction can be along the longitudinal axis 214.

One problem with existing rotation bases for umbrella assemblies is parts that are easily broken and/or difficult to replace. Accordingly, the assembly including the clip 168 and the pin 164 can make the clip 168 and/or the pin 164 easily replaceable. Optionally, the clip 168 and the pin 164 can require no mechanical fasteners to attach with the actuator 156. A spacing between an inner periphery of the actuator body 196 at the lock end 176 and the mount 126 can be less than a length necessary to insert the clip 168 over the span of the lock end 176 with the actuator coupled with the upper support 152 (e.g., by the pivot 172). Accordingly, the clip 168 can be assembled with the actuator 156 before the actuator 156 is coupled to upper support 152. The mount 126 can help to maintain the clip 168 and/or the pin 164 attached with the actuator 156. Although the clip 168 will normally securely connect to the actuator 156, the clearance between the mount 126 and the clip 168 can be small enough that the clip will not completely separate from the actuator 156 if partially dislodged.

Actuator Assembly Operation

The actuator assembly can be moved between the locked configuration of FIG. 2 and the rotation configuration of FIG. 4. The locked configuration locks, e.g., prevents, minimizes, or reduces rotation of the mount 126 and thereby the umbrella canopy of the umbrella assembly 100 coupled thereto. The rotation configuration shown in FIG. 4 allows rotation of the mount 126 and thereby the umbrella canopy of the umbrella assembly 100 coupled thereto. A user can select the configuration by use of the foot pedal 160. A user can enter the rotation configuration by stepping on or otherwise depressing the foot pedal 160 to raise the pin 164 out of engagement with the lower support 148 (e.g., any of the apertures 188). The upright pole 116 and umbrella canopy assembly 110 can then be rotated relative to the lower support 148 about the rotation axis 153. A user can enter the locked configuration by releasing the foot pedal 160 to allow the pin 164 to engage within the aperture 188. In some variations the pin 164 will automatically enter the nearest aperture 188 due to the action of the spring 178. In other embodiments, the rotation configuration can be maintained without continuous pressure on the foot pedal 160. For example, the base assembly can include a latch to hold the position of the foot pedal 160. Entering the locked configuration can also include aligning the aperture 188 with the aperture 186 by rotation of the upright pole 116. The dome tip 212 of the free end 164*a* and/or a tapered surface 189 of the aperture 188 can also help to align slightly misaligned aperture 186, 188. If the pin 164 is misaligned from the nearest aperture 188 by less than the diameter of the shaft of the pin between the dome tip 212 and the tapered portion 209, the pin can self align into the aperture by the integration of the tip 212 and the tapered opening 189.

Figure 12:
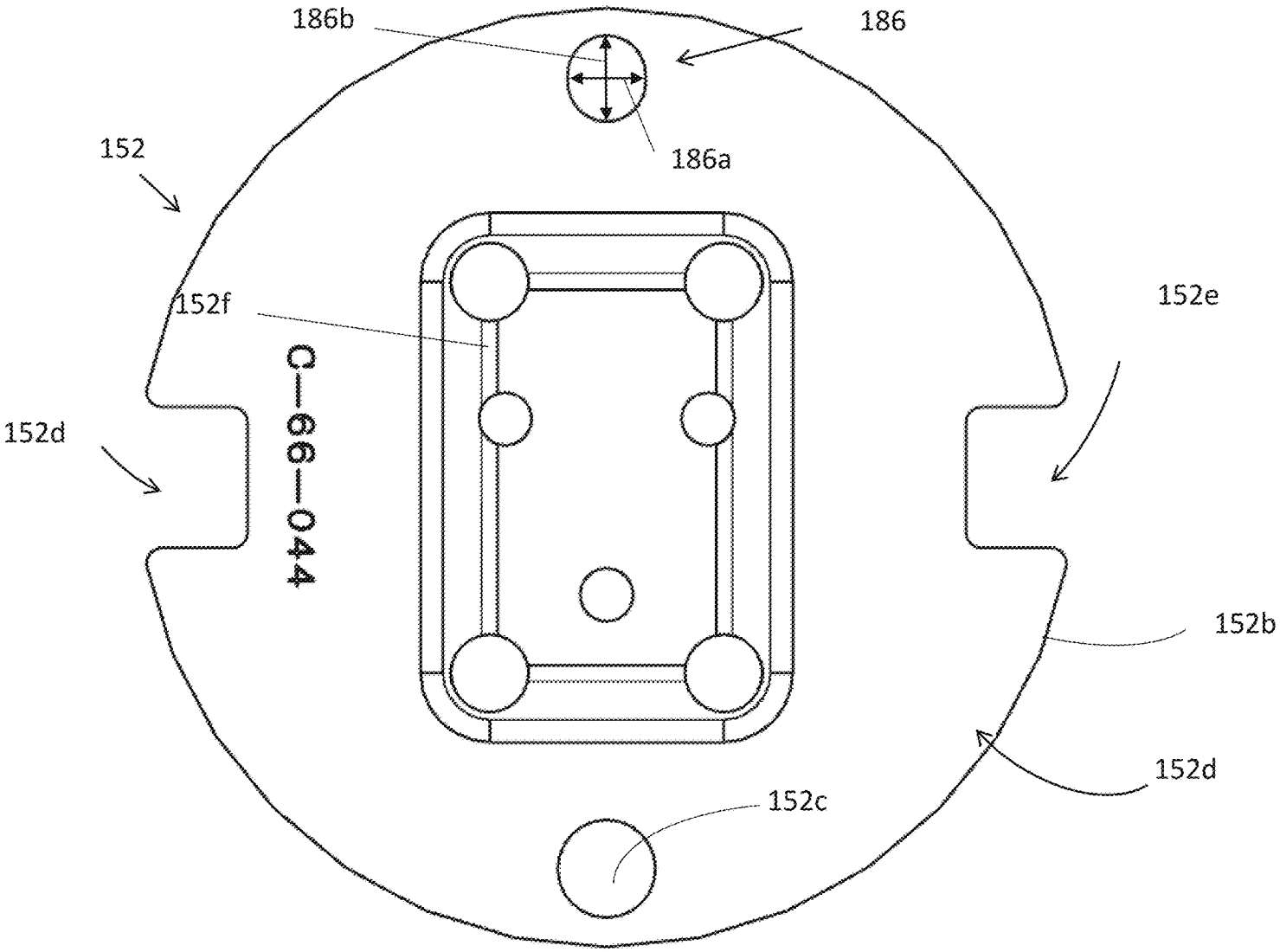
FIG. 12 is a top view of a first support which can be an upper support of the actuator assembly of FIG. 2.

FIG. 12 shows further detail of the upper support 152. The actuator 156 pivots about the pivot 172 between the locked and rotation configurations. As the lock end 176 lifts or lowers the pin 164, the pin 164 moves along a curve centered on the pivot 172. Accordingly, the aperture 186 can be a slot or have a diameter greater than the diameter of the body 164*c* to allow for the pin 164 to be inserted or removed from the aperture 186 at an angle. If the aperture 186 is a slot, the slot can have a major axis or length 186*b* that is longer than a minor axis or width 186*a* (e.g., oval or elliptical). The length 186*b* can be aligned along a radial direction of the upper support 152. The width 186*a* can be aligned transverse to the radial direction. By aligning the width 186*a* in the circumferential direction there is less play among the rotation base in the locked configuration than were the entire aperture 186 of a larger diameter.

The upper support 152 can be generally circular. The upper support 152 can include an outer periphery 152*b*. The outer periphery 152*b* can be generally circular. The outer periphery 152*b* can include one or more cut-outs 152*d*, 152*e*. The cut-outs 152*d*, 152*e* can be sized to receive the flanges 192, 193 of the actuator 156. The pivot 172 can be aligned with the cut-outs 152*d*, 152*e*. Each of the cut-outs 152*d*, 152*e* can include an aperture therein for receiving the pivot member of the pivot 172.

An upper surface of the upper support 152 can include a recess 152*c*. The recess 152*c* can engage with and/or retain the lower end of the spring 178. The recess 152*c* can maintain alignment of the spring 178 with the upper support 152. The recess 152*c* can extend less than one-half the thickness of the upper support 152 from the top surface thereof toward the bottom surface. In another embodiment, the recess 152*c* can be a protrusion for engaging with the spring 178.

The upper surface of the upper support 152 can include one or more recessed portions 152*f*. The recessed portions 152*f* can include alignment grooves and/or apertures for attaching the mount 126 with the upper support 152.

FIG. 13 shows further detail of the lower support 148. The lower support 148 can be generally circular. The lower support 148 can include an outer periphery 148*c*. The outer periphery 148*c* can be generally circular. The lower support 148 can include the plurality of aperture 188. The plurality of apertures 188 can extend around the outer periphery 148*c*. The plurality of aperture 188 can extend entirely around the outer periphery 148*c*, at discrete intervals.

The plurality of apertures 188 can each extend through the lower support 148. In some embodiments, the plurality of apertures 188 are only recesses within the lower support 148 (e.g., that do not extend fully through). The plurality of apertures 188 can be fully enclosed (e.g., 360°). One or more of apertures 188 can be open apertures 188*a*, which are apertures that are open to the periphery of the lower support 148 on one or more sides. The apertures 188*a* can be between enclosed apertures 188. The open apertures 188*a* can align with respective bolts of the plurality of bolts 191 that attach the base support 144 with the base assembly 120. The open sides of the apertures 188*a* can facilitate assembly of the base support 144 with the base assembly 120 by the bolts 191. This can allow the base support 144 to be more compact (e.g., without the open side of the aperture 188*a*, the bolts 191 could only be assembled at a wider diameter than the periphery 148*c*, in some implementations). By retaining pin engaging features, such as the tapered opening 189, the open apertures 188*a* are able to provide a continuous distance between adjacent apertures even while accommodating assembly, as described above.

Certain Terminology

Terms of orientation used herein, such as "top," "bottom," "proximal," "distal," "longitudinal," "lateral," and "end," are used in the context of the illustrated example. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular," "cylindrical," "semi-circular," or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain examples include or do not include, certain features, elements, and/or steps. Thus, such conditional language is not generally intended to imply that features, elements, and/or steps are in any way required for one or more examples.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain examples require the presence of at least one of X, at least one of Y, and at least one of Z.

The terms "approximately," "about," and "substantially" as used herein represent an amount close to the stated amount that still performs a desired function or achieves a desired result. For example, in some examples, as the context may dictate, the terms "approximately," "about," and "substantially," may refer to an amount that is within less than or equal to 10% of the stated amount. The term "generally" as used herein represents a value, amount, or characteristic that predominantly includes or tends toward a particular value, amount, or characteristic. As an example, in certain examples, as the context may dictate, the term "generally parallel" can refer to something that departs from exactly parallel by less than or equal to 20 degrees. All ranges are inclusive of endpoints.

SUMMARY

Several illustrative examples of umbrellas have been disclosed. Although this disclosure has been described in terms of certain illustrative examples and uses, other examples and other uses, including examples and uses which do not provide all of the features and advantages set forth herein, are also within the scope of this disclosure. Components, elements, features, acts, or steps can be arranged or performed differently than described and components, elements, features, acts, or steps can be combined, merged, added, or left out in various examples. All possible combinations and subcombinations of elements and components described herein are intended to be included in this disclosure. No single feature or group of features is necessary or indispensable.

Certain features that are described in this disclosure in the context of separate implementations can also be implemented in combination in a single implementation. Conversely, various features that are described in the context of a single implementation also can be implemented in multiple implementations separately or in any suitable subcombination. Moreover, although features may be described above as acting in certain combinations, one or more features from a claimed combination can in some cases be excised from the combination, and the combination may be claimed as a subcombination or variation of a subcombination.

Any portion of any of the steps, processes, structures, and/or devices disclosed or illustrated in one example in this disclosure can be combined or used with (or instead of) any other portion of any of the steps, processes, structures, and/or devices disclosed or illustrated in a different example or flowchart. The examples described herein are not intended to be discrete and separate from each other. Combinations, variations, and some implementations of the disclosed features are within the scope of this disclosure.

While operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Additionally, the operations may be rearranged or reordered in some implementations. Also, the separation of various components in the implementations described above should not be understood as requiring such separation in all implementations, and it should be understood that the described components and systems can generally be integrated together in a single product or packaged into multiple products. Additionally, some implementations are within the scope of this disclosure.

Further, while illustrative examples have been described, any examples having equivalent elements, modifications, omissions, and/or combinations are also within the scope of this disclosure. Moreover, although certain aspects, advantages, and novel features are described herein, not necessarily all such advantages may be achieved in accordance with any particular example. For example, some examples within the scope of this disclosure achieve one advantage, or a group of advantages, as taught herein without necessarily achieving other advantages taught or suggested herein. Further, some examples may achieve different advantages than those taught or suggested herein.

Some examples have been described in connection with the accompanying drawings. The figures are drawn and/or shown to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various examples can be used in all other examples set forth herein. Additionally, any methods described herein may be practiced using any device suitable for performing the recited steps.

For purposes of summarizing the disclosure, certain aspects, advantages and features of the inventions have been described herein. Not all, or any such advantages are necessarily achieved in accordance with any particular example of the inventions disclosed herein. No aspects of this disclosure are essential or indispensable. In many examples, the devices, systems, and methods may be configured differently than illustrated in the figures or description herein. For example, various functionalities provided by the illustrated modules can be combined, rearranged, added, or deleted. In some implementations, additional or different processors or modules may perform some or all of the functionalities described with reference to the examples described and illustrated in the figures. Many implementation variations are possible. Any of the features, structures, steps, or processes disclosed in this specification can be included in any example.

In summary, various examples of umbrellas have been disclosed. This disclosure extends beyond the specifically disclosed examples to other alternative examples and/or other uses of the examples, as well as to certain modifications and equivalents thereof. Moreover, this disclosure expressly contemplates that various features and aspects of the disclosed examples can be combined with, or substituted for, one another. Accordingly, the scope of this disclosure should not be limited by the particular disclosed examples described above, but should be determined only by a fair reading of the claims.

What is claimed is:

1. An umbrella base, comprising:

a first support configured to be coupled to a fixed base or ground support, the first support comprising a plurality of enclosed apertures extending from a first opening on a top surface of the first support to a second opening on a bottom surface of the first support;

a second support rotatably coupled to the first support;

an actuator pivotably coupled to the second support, the actuator comprising:

a foot pedal disposed at a first end; and a pin disposed at a second end of the actuator opposite the foot pedal, the pin having a free end disposed away from the second end of the actuator and a fixed end removably coupled to the second end of the actuator whereby the pin can be removed from the actuator without removing the actuator from the second support; and a spring disposed between the foot pedal and the second support, the spring being configured to bias the pin into any one of the plurality of enclosed apertures;

wherein, in use, depressing the foot pedal retracts the pin from any one of the plurality of enclosed apertures and raising the foot pedal returns the pin into one of the plurality of enclosed apertures.

2. The umbrella base of claim 1, wherein the actuator further comprises a removable clip coupled to the second end of the actuator, the removable clip comprising a slot configured to receive the fixed end of the pin.

3. The umbrella base of claim 1, wherein the second support comprises a slot that surrounds the pin in at least a locked configuration.

4. An umbrella base, comprising:

a first support configured to be coupled to a fixed base or ground support, the first support comprising a plurality of enclosed apertures extending from a first opening on a top surface of the first support to a second opening on a bottom surface of the first support;

a second support rotatably coupled to the first support;

an actuator pivotably coupled to the second support, the actuator comprising:

a foot pedal disposed at a first end; and a pin disposed at a second end of the actuator opposite the foot pedal, the pin having a free end disposed away from the second end of the actuator and a fixed end coupled to the second end of the actuator; and a spring disposed between the foot pedal and the second support, the spring being configured to bias the pin into any one of the plurality of enclosed apertures;

wherein, in use, depressing the foot pedal retracts the pin from any one of the plurality of enclosed apertures and raising the foot pedal returns the pin into one of the plurality of enclosed apertures;

wherein first support further comprises an open aperture formed in an outer periphery between two adjacent enclosed apertures, the open aperture configured to receive the pin.

5. The umbrella base of claim 1, wherein the pin comprises a narrowed region adjacent to the free end.

6. An umbrella base, comprising:

a first support configured to be coupled to a fixed base or ground support, the first support comprising a plurality of enclosed apertures extending from a first opening on a top surface of the first support to a second opening on a bottom surface of the first support;

a second support rotatably coupled to the first support;

an actuator pivotably coupled to the second support, the actuator comprising:

a foot pedal disposed at a first end; and a pin disposed at a second end of the actuator opposite the foot pedal, the pin having a free end disposed away from the second end of the actuator and a fixed end coupled to the second end of the actuator; and a spring disposed between the foot pedal and the second support, the spring being configured to bias the pin into any one of the plurality of enclosed apertures;

wherein, in use, depressing the foot pedal retracts the pin from any one of the plurality of enclosed apertures and raising the foot pedal returns the pin into one of the plurality of enclosed apertures;

wherein the pin comprises a tapered surface in a middle section of the pin; and wherein the enclosed apertures comprise a tapered surface extending from the first opening toward the second opening, the tapered surface of the enclosed apertures configured to engage the tapered surface in the middle section of the pin.

7. The umbrella base of claim 1, wherein the fixed end of the pin comprises a notch.

8. The umbrella base of claim 6, wherein the second end of the actuator comprises a correspondingly shaped slot configured to receive the notch of the fixed end of the pin.

9. The umbrella base of claim 8, wherein the second end of the actuator comprises a removable clip comprising the notch-shaped slot.

10. The umbrella base of claim 9, wherein the actuator comprises a ring shaped body disposed between the first end and the second end thereof, the clip being secured to an inner periphery of the ring shaped body.

11. The umbrella base of claim 10, wherein the clip comprises a first surface, a second surface opposite the first surface, and a gap disposed therebetween, the gap configured to receive a span of the ring shaped body.

12. The umbrella base of claim 11, wherein the gap faces radially outwardly and the clip encloses a radially inward side of the span of the ring shaped body.

13. The umbrella base of claim 1, wherein the actuator comprises a ring shaped body disposed between the first end and the second end thereof, the ring shaped body disposed about an outer periphery of a pole mount attached with the second support with the first and second ends on opposite sides of the pole mount.

14. The umbrella base of claim 13, wherein the pin is coupled to a span of the ring shaped body opposite the foot pedal.

15. The umbrella base of claim 14, further comprising a clip coupled to the pin, the clip having a gap configured to receive a span of the ring shaped body.

16. The umbrella base of claim 15, wherein the clip is positioned between the span of the ring shaped body and the umbrella pole mount such that clip is retained on the second end of the actuator.

17. An umbrella base, comprising:

a first support configured to be coupled to a fixed base or ground support, the first support comprising a plurality of apertures extending from an opening on a surface of the first support;

a second support rotatably coupled to the first support;

an actuator pivotably coupled to the second support, the actuator comprising:

a controller disposed at a first end; and a pin assembly disposed at a second end of the actuator opposite the controller, the pin assembly including a pin having a free end disposed away from the second end of the actuator and a fixed end secured to the second end of the actuator by a clip, the fixed end of the pin positioned above the second support;

wherein the controller is configured to retract the free end of the pin from any one of the plurality of apertures;

wherein the controller is configured to insert the free end of the pin into any one of the plurality of apertures;

wherein the clip comprises a slot, the slot configured to receive a notch on the fixed end of the pin.

18. The umbrella base of claim 17, further comprising an umbrella pole mount, wherein the clip is secured to an inner periphery of the actuator between the inner periphery and the umbrella pole mount such that the clip is retained on the second end of the actuator.

19. The umbrella base of claim 17, wherein the pin extends through a slot in the second support and into any one of the plurality of apertures of the first support to prevent the umbrella base from rotating.

20. The umbrella base of claim 19, wherein the slot is oriented in a direction transverse to a rotational axis of the second support.

21. The umbrella base of claim 19, wherein the slot in the second support has a length and a width, the length being greater than a diameter of the pin such that the pin can move along the slot along an arc as the second end of the actuator pivots with respect to the second support.

22. An umbrella base, comprising:

a first support configured to be coupled to a fixed base, the first support comprising a plurality of apertures extending from an opening on a surface of the first support;

a second support rotatably coupled to the first support, the second support including a slot;

an actuator coupled with the second support, the actuator comprising:

a first portion; and a second portion disposed away from the first portion;

a pin assembly disposed at the second portion, the pin assembly including a pin having a free end disposed away from the second portion of the actuator, the pin being secured to the second portion of the actuator by a removable clip;

wherein lowering the first portion retracts the free end of the pin from any one of the plurality of apertures and allows rotation of the second support relative to the first support;

wherein raising the first portion with the slot vertically aligned above any one of the plurality of apertures inserts the free end of the pin into any one of the plurality of apertures by extension through the slot and prevents rotation of the second support relative to the first support;

wherein the actuator comprises a ring shaped body having an inner periphery configured to be disposed outward of and surround an umbrella pole when the umbrella base is coupled with an umbrella pole.

23. The umbrella base of claim 22, wherein the pin is removably coupled to the clip at a fixed end of the pin.

* * * * *